US011688987B2

(12) United States Patent
Liu et al.

(10) Patent No.: US 11,688,987 B2
(45) Date of Patent: Jun. 27, 2023

(54) TERMINATING TOOL FOR TERMINATING WIRES TO A COMMUNICATION MODULE; AND METHODS

(71) Applicant: COMMSCOPE TECHNOLOGIES LLC, Hickory, NC (US)

(72) Inventors: Zhihui Liu, Jiangsu (CN); Jing Wang, Jiangsu (CN); Wenyong Wu, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/376,935

(22) Filed: Jul. 15, 2021

(65) Prior Publication Data

US 2022/0021168 A1 Jan. 20, 2022

(30) Foreign Application Priority Data

Jul. 17, 2020 (CN) ..... 202010689944.X
Jul. 17, 2020 (CN) ..... 202021420879.2

(51) Int. Cl.

| | |
|---|---|
| ***H01R 43/01*** | (2006.01) |
| ***H01R 43/042*** | (2006.01) |
| ***H01R 107/00*** | (2006.01) |
| ***H01R 24/64*** | (2011.01) |

(52) U.S. Cl.

CPC ..... *H01R 43/015* (2013.01); *H01R 43/0425* (2013.01); *H01R 24/64* (2013.01); *H01R 2107/00* (2013.01); *Y10T 29/49185* (2015.01); *Y10T 29/53226* (2015.01)

(58) Field of Classification Search

CPC ..... Y10T 29/49174; Y10T 29/49181; Y10T 29/49185; Y10T 29/49188; Y10T 29/4919; Y10T 29/53213; Y10T 29/53217; Y10T 29/53222; Y10T 29/53266; Y10T 29/53235; H01R 43/01; H01R 43/015; H01R 43/04; H01R 43/042; H01R 43/0421; H01R 43/0425; H01R 43/048; H01R 43/0488

See application file for complete search history.

(56) References Cited

U.S. PATENT DOCUMENTS

| | | | |
|---|---|---|---|
| 5,647,119 | A | 7/1997 | Bourbeau et al. |
| 5,832,603 | A | 11/1998 | Fallandy |
| 6,230,387 | B1 | 5/2001 | Gritters et al. |
| 6,872,090 | B2 | 3/2005 | De Dios Martin |
| 7,073,245 | B2 | 7/2006 | Alexander et al. |

(Continued)

FOREIGN PATENT DOCUMENTS

| | | | |
|---|---|---|---|
| CN | 101651282 | A | 2/2010 |
| EP | 1 422 793 | A1 | 5/2004 |

(Continued)

*Primary Examiner* — Peter Dungba Vo
*Assistant Examiner* — Joshua D Anderson
(74) *Attorney, Agent, or Firm* — Merchant & Gould P.C.

(57) ABSTRACT

Aspects and techniques of the present disclosure relate to a tool capable of terminating two different jack types (i.e. communication modules). That is, two different jack types can be arranged and configured to sit in the tool with a termination device. The tool can be a dual-purpose tool that has a configuration that allows a user to terminate different style jacks by adding termination device that becomes a lacing fixture.

16 Claims, 38 Drawing Sheets

(56) References Cited

U.S. PATENT DOCUMENTS

| | | | | |
|---|---|---|---|---|
| 7,103,968 | B2 | 9/2006 | Karrasch | |
| 7,444,744 | B2 | 11/2008 | Caveney et al. | |
| 7,594,315 | B2 * | 9/2009 | Montena | B25B 27/10 29/748 |
| 7,627,944 | B2 | 12/2009 | Holliday | |
| 7,877,864 | B2 * | 2/2011 | Montena | H01R 43/0427 29/749 |
| 8,283,564 | B2 | 10/2012 | James et al. | |
| 8,418,346 | B2 | 4/2013 | Chen | |
| 8,418,347 | B2 | 4/2013 | Chen | |
| 8,881,368 | B2 | 11/2014 | Lin | |
| 8,952,703 | B2 | 2/2015 | Font Aranega et al. | |
| 9,276,368 | B2 | 3/2016 | Mateo Ferrus et al. | |
| 10,439,352 | B2 | 10/2019 | Cheng et al. | |
| 10,535,969 | B2 | 1/2020 | Sutter | |
| 2003/0145457 | A1 | 8/2003 | Griffin et al. | |
| 2006/0230608 | A1 | 10/2006 | Caveney et al. | |
| 2008/0263859 | A1 * | 10/2008 | Wang | H01R 43/0425 29/751 |
| 2010/0071202 | A1 | 3/2010 | Peng et al. | |
| 2012/0246919 | A1 * | 10/2012 | Evans | H01R 43/042 29/753 |
| 2013/0125381 | A1 | 5/2013 | Lin | |
| 2016/0072220 | A1 | 3/2016 | Wang et al. | |
| 2018/0090899 | A1 | 3/2018 | Font Aranega et al. | |
| 2020/0014164 | A1 | 1/2020 | Cheng et al. | |

FOREIGN PATENT DOCUMENTS

| | | | |
|---|---|---|---|
| WO | 2015/056246 | A1 | 4/2015 |
| WO | 2015/056246 | A8 | 4/2015 |

* cited by examiner

TERMINATING TOOL FOR TERMINATING WIRES TO A COMMUNICATION MODULE; AND METHODS

This application claims the benefit of Chinese Patent Application No. 202010689944.X, filed on Jul. 17, 2020 and Chinese Patent Application No. 202021420879.2, filed on Jul. 17, 2020, the disclosures of which are incorporated herein by reference in their entireties.

TECHNICAL FIELD

The present disclosure relates to a tool capable of terminating wires of a cable to two different types of communication modules and methods of performing such a termination using the tool.

BACKGROUND

In various network communication terminals, such as, computer, router, server, exchange, etc., a user terminal is electrically connected to an external cable, generally, by inserting a plug connector into a communication module, for example, a receptacle connector mounted in a wall.

In prior art, a method for terminating wires of cable to communication module generally requires a specific tool for a particular type of communication module. As such, multiple tools or tool parts may be needed to terminate various types of communication modules.

Accordingly, tools and methods are needed that improves upon these disadvantages in the prior art.

SUMMARY

Aspects of the present disclosure relate to a tool for terminating a cable having a plurality of wires with different types of communication modules that each have a plurality of connection terminals. The tool is capable of terminating two different jack types.

The tool can include a base, a slider mounted to the base, and a pivotable lever arm coupled to the base and to the slider. The base of the tool can define pockets for receiving a first jack type and a second jack type. If the first jack type is terminated, only the slider may be used. If the second jack type is terminated, a termination device including a lacing fixture for holding wires of a cable can be added to the slider. In certain examples, a termination device can be added to the slider and the second jack can include a lacing fixture for holding wires of a cable. As such, the tool can be a dual-purpose tool that has a configuration that allows a user to terminate different style jacks by adding a termination device that can become a lacing fixture.

One aspect of the present disclosure relates to a tool for terminating different jack types. The tool can include a housing with a base that supports a first jack type and a second jack type. The tool can also include a slider. The slider can be mounted within a slot defined in the base.

In certain examples, the slider can directly engage the first jack type when terminating the first jack type.

In certain examples, the slider can receive a termination device that directly engages the second jack type when terminating the second jack type.

The tool can include a pivotable lever arm that can be coupled to the housing and to the slider. The pivotable lever arm can be configured to linearly move the slider between an initial position and a final position.

Another aspect of the present disclosure relates to a method of terminating a cable having a plurality of wires with a communication module having a plurality of connection terminals. The method can include a step of providing a tool that includes a base, a slider mounted within a slot defined in the base, and a pivotable lever arm coupled to the base and to the slider.

The method can include a step of attaching a termination device to the slider. The termination device can have a lacing fixture that holds the plurality of wires of the cable.

The method can also include a step of inserting the communication module vertically into the base adjacent the lacing fixture.

The method can further include a step of pressing the pivotable lever arm to move the slider into engagement with the communication module to terminate the plurality of wires of the cable to the plurality of connection terminals of the communication module.

A further aspect of the present disclosure relates to a method of using a termination tool for different jack types. The termination tool can include a housing with a base, a pivotable lever arm attached to the housing, and a slider mounted on the base of the termination tool. The slider can be attached to the pivotable lever arm via a linkage. The method includes a step of arranging the termination tool in a first jack configuration that includes: mounting a first termination device at a distal end of the base of the termination tool where the first termination device has a first plurality of wires of a first cable; inserting a first jack horizontally onto the base of the housing between the slider and the first termination device; pressing the pivotable lever arm to a closed position to move the slider toward the first jack to respectively terminate the first plurality of wires of the first cable to a plurality of connection terminations of the first jack; and opening the pivotable lever arm and removing the first jack and the first termination device. The method can also include a step of arranging the termination tool in a second jack configuration that includes: attaching a second termination device to the slider positioned on the base of the housing; inserting a second jack vertically into the base of the housing adjacent the second termination device at the distal end of the base; pressing the pivotable lever arm to the closed position to move the second termination device into engagement with the second jack to respectively terminate a second plurality of wires of a second cable to connection terminations of the second jack; and opening the pivotable lever arm and removing the second jack.

In certain examples, the second termination device can be configured to hold the second plurality of wires of the second cable. In certain examples, the second jack can be configured to hold the second plurality of wires of the second cable.

These and other features and advantages will be apparent from a reading of the following detailed description and a review of the associated drawings. A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

The present disclosure relates to a tool capable of terminating two different jack types (i.e. communication modules). That is, two different jack types can be arranged and configured to sit in the tool with a lacing fixture. In the examples provided, the two different jack types are RJ-45 jack types, that typically terminate to cables with four twisted wire pairs of the cable.

The tool can be a dual-purpose tool that has a configuration that allows a user to terminate different style jacks by adding an insert piece that becomes a lacing fixture. That is, the tool can be used in two different configurations such that a separate tool is not necessary to terminate two different types of communication modules, saving cost and time.

The tool capable of terminating wires of a cable to a communication module may be used in a single operation. The communication module may be easily and quickly mounted to or removed from the tool, saving the operation time and increasing the work efficiency.

Furthermore, the method according to the present disclosure for terminating the wires of a cable to a communication module may be performed reliably and stably, improving the reliability of the network wiring.

Figure 1:
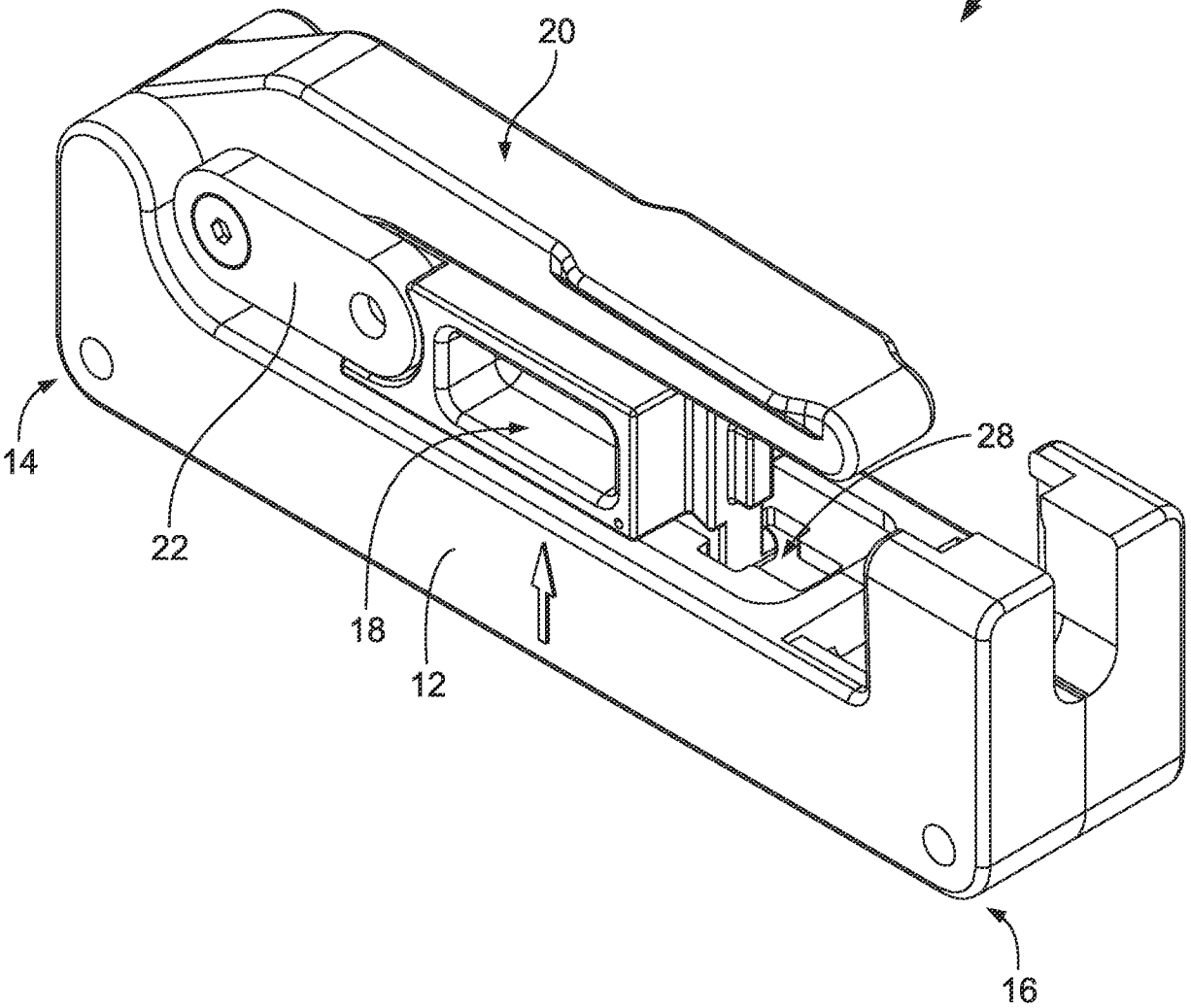
FIG. 1 illustrates a perspective view of an example termination tool that includes a pivotable lever arm and a slider in accordance with principles of the present disclosure.
Figure 2:
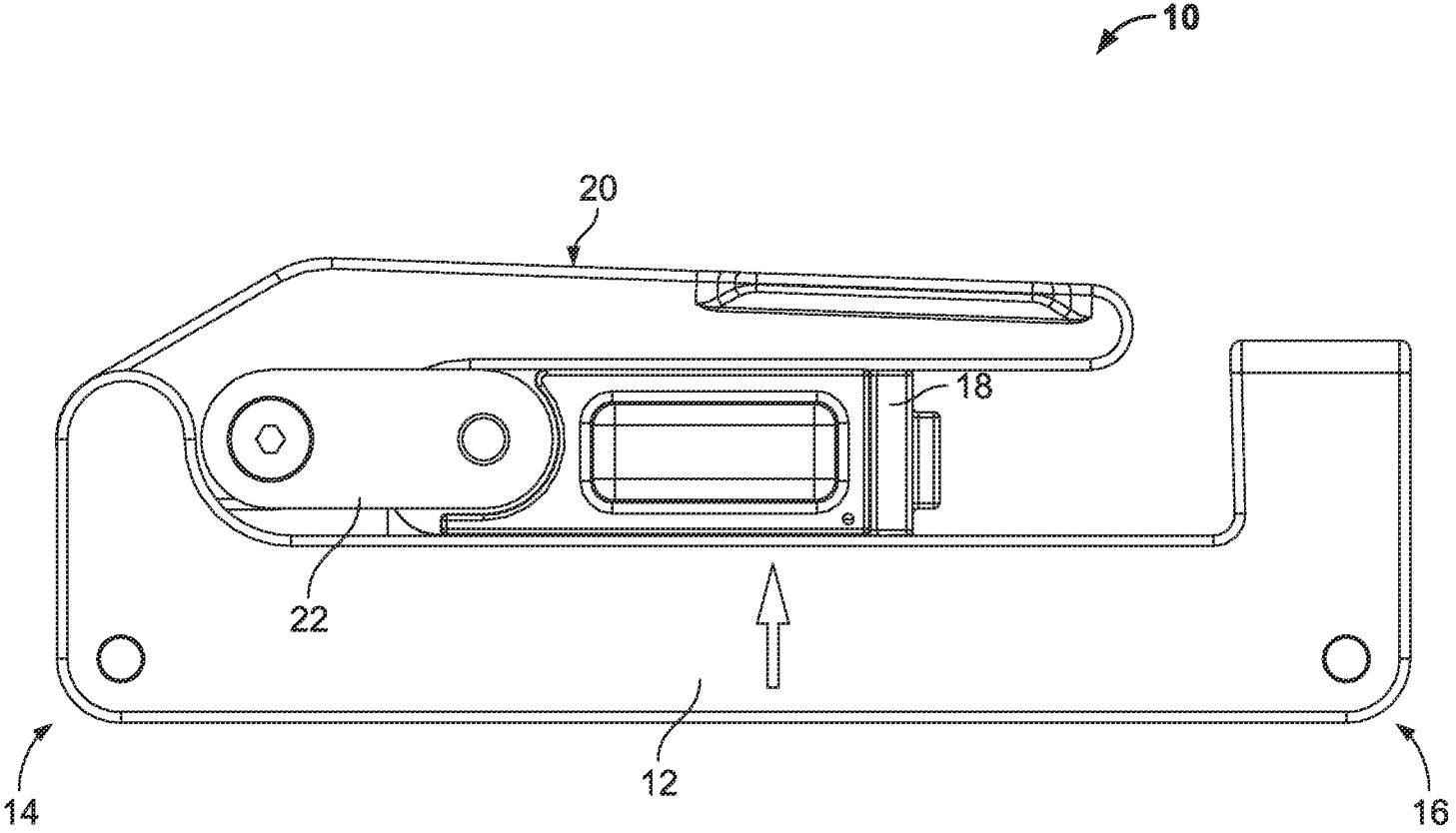
FIG. 2 illustrates a side view of the termination tool of FIG. 1.

FIGS. 1-2 illustrate a tool 10 (e.g., pressing tool, termination tool) for terminating wires of a cable to two different types of communication modules. The tool 10 can be used with termination devices. In a preferred embodiment, the termination devices include a wire pushing portion and a wire cutting portion, although alternatives are possible. In certain embodiments, the termination devices can also include a wire holding portion.

The tool 10 can include a base 12 with a first end 14 and an opposite second end 16. The tool 10 can also include a slider 18, a pivotable lever arm 20, and a link 22. The link 22 can be pivotally connected to the pivotable lever arm 20 and to the slider 18.

Figure 3:
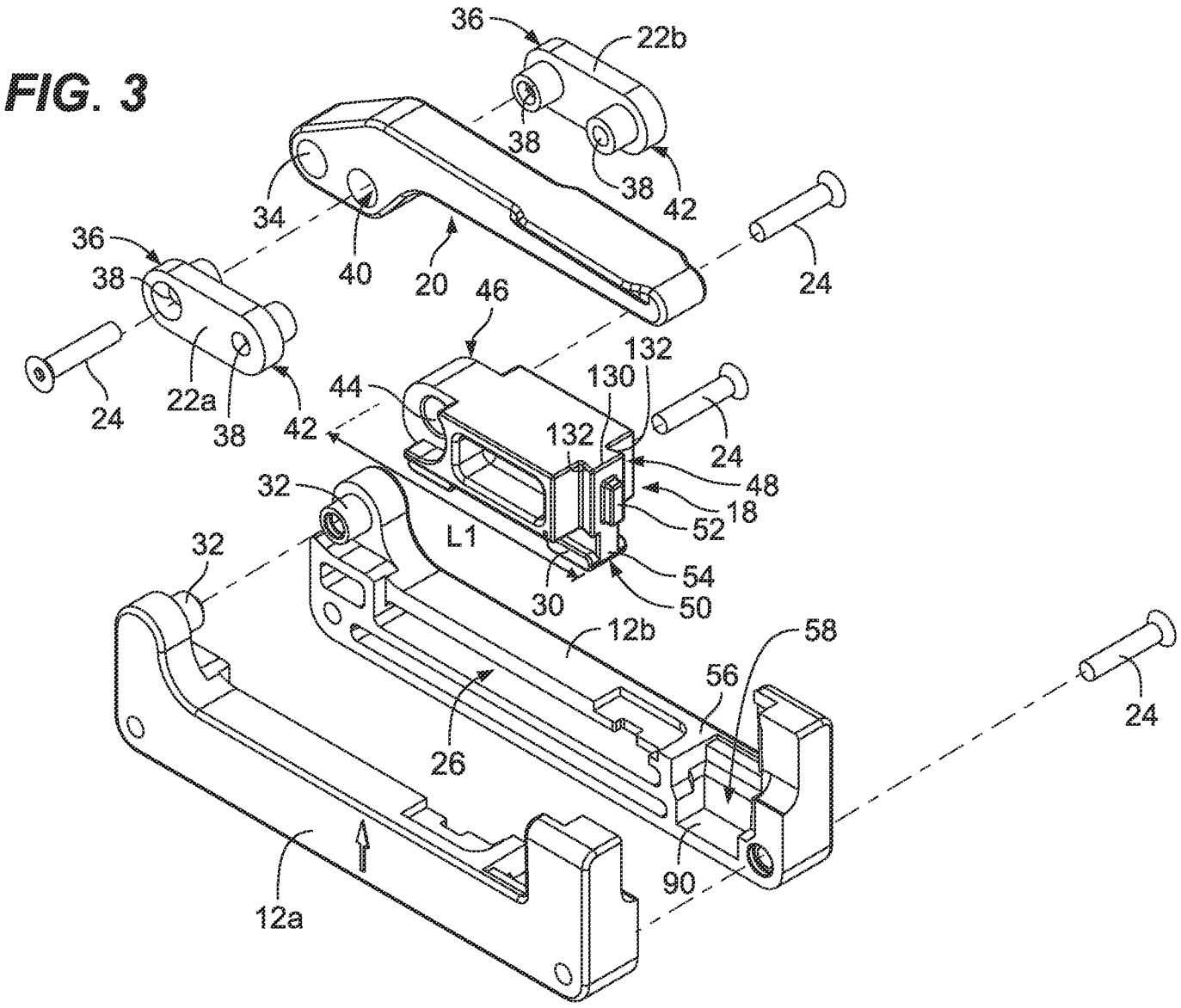
FIG. 3 illustrates an exploded view of the termination tool of FIG. 1.

Referring to FIG. 3, an exploded view of the tool 10 is depicted. The base 12 of the tool 10 can include two substantially identical half bodies 12*a*, 12*b* that are assembled together by fasteners, for example, bolts 24. Each of the half bodies 12*a*, 12*b* can define a notch 26 that together form a guide slot 28 when the half bodies 12*a*, 12*b* are assembled together.

The slider 18 can include sliding rail feet 30 that are received within the guide slot 28 for slidably engaging the slider 18 relative to the base 12. In this way, the slider 18 may be stably linearly slid on the base 12.

The pivotable lever arm 20 can be coupled to the base 12 via a pivotal shaft 32 that mounts within a first opening 34 defined in the pivotable lever arm 20 at the first end 14 of the tool 10. The pivotable lever arm 20 is also coupled to the slider 18 via the link 22.

In certain examples, the link 22 can include two linkages 22*a*, 22*b* that are connected together via fasteners 24. First ends 36 of the linkages 22*a*, 22*b* can be coupled to the pivotable lever arm 20 by inserting the fastener 24 through apertures 38 of the two linkages 22*a*, 22*b* and through a second opening 40 of the pivotable lever arm 20. Second ends 42 of the linkages 22*a*, 22*b* can define apertures 38 for receiving a fastener 24. The fastener 24 can be received within an opening 44 defined at a first end 46 of the slider to couple the link 22 to the slider 18. Because the link 22 is connected to the pivotable lever arm 20 and the slider 18, the slider 18 can be linearly moved on the base 12 when the pivotable lever arm 20 is rotated relative to the base 12. That is, the pivotable lever arm 20 can be rotated about the pivotal shaft 32 from a maximally open working position towards a closed working position to linearly move the slider 18 between an initial position and a final position.

In certain examples, the slider 18 can include a dovetail tongue portion 48 at a second end 50 thereof. The dovetail tongue portion 48 can have a protrusion 52 that extends from a front face 54 of the dovetail tongue portion 48, although alternatives are possible. The slider 18 of the tool 10 can be arranged and configured such that two different style jacks can be terminated. As such, a separate base 12 or slider 18 is not necessary to achieve two different configurations.

Figure 4:
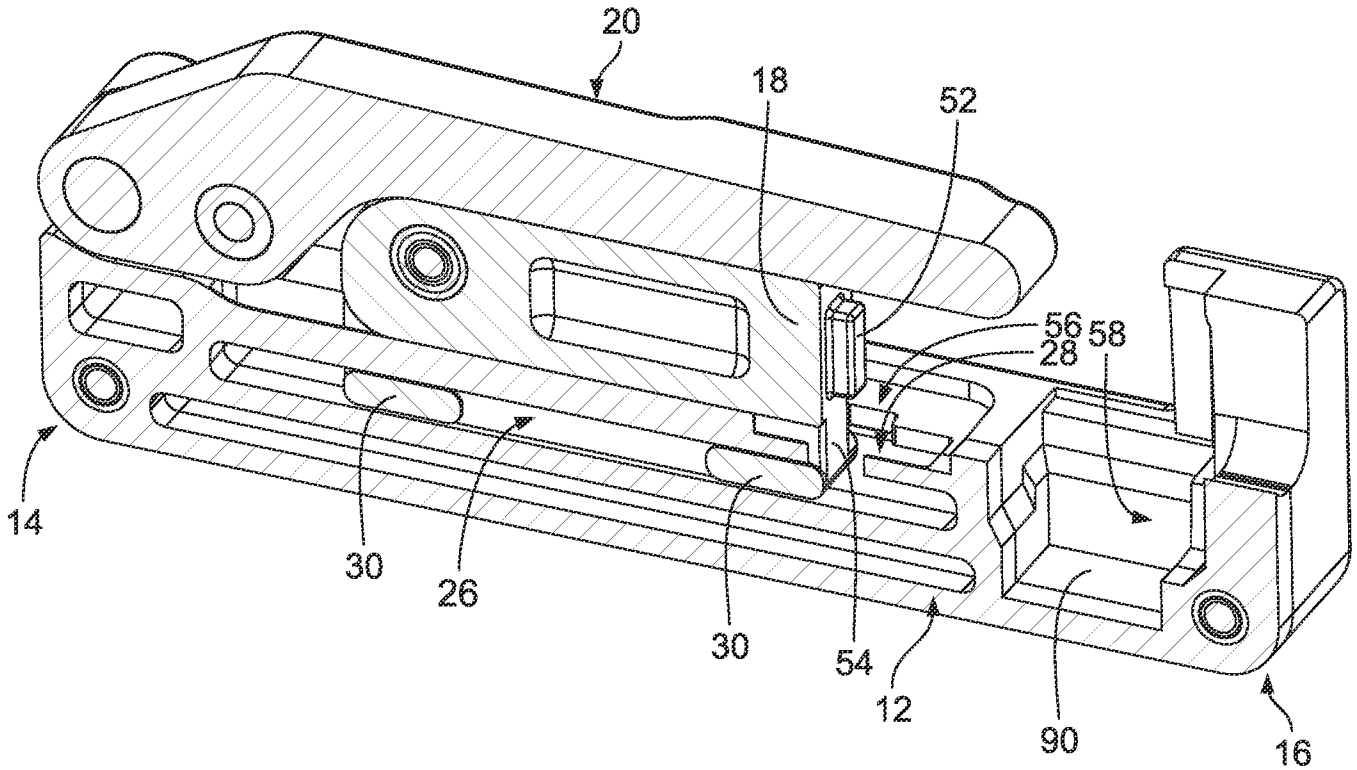
FIG. 4 illustrates a cross-sectional view of the termination tool of FIG. 1.
Figure 5:
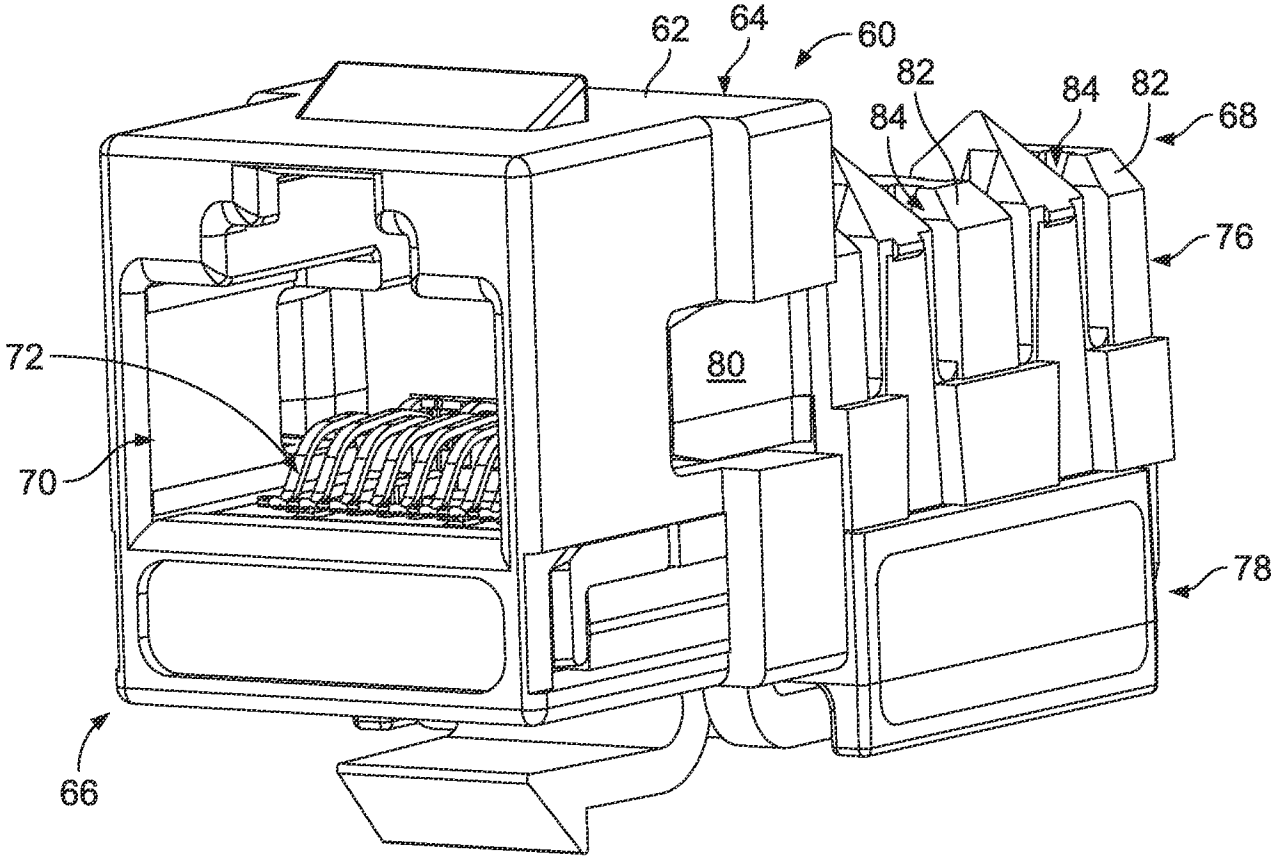
FIG. 5 illustrates a front perspective view of an example vertical style communication module in accordance with the principles of the present disclosure.
Figure 6:
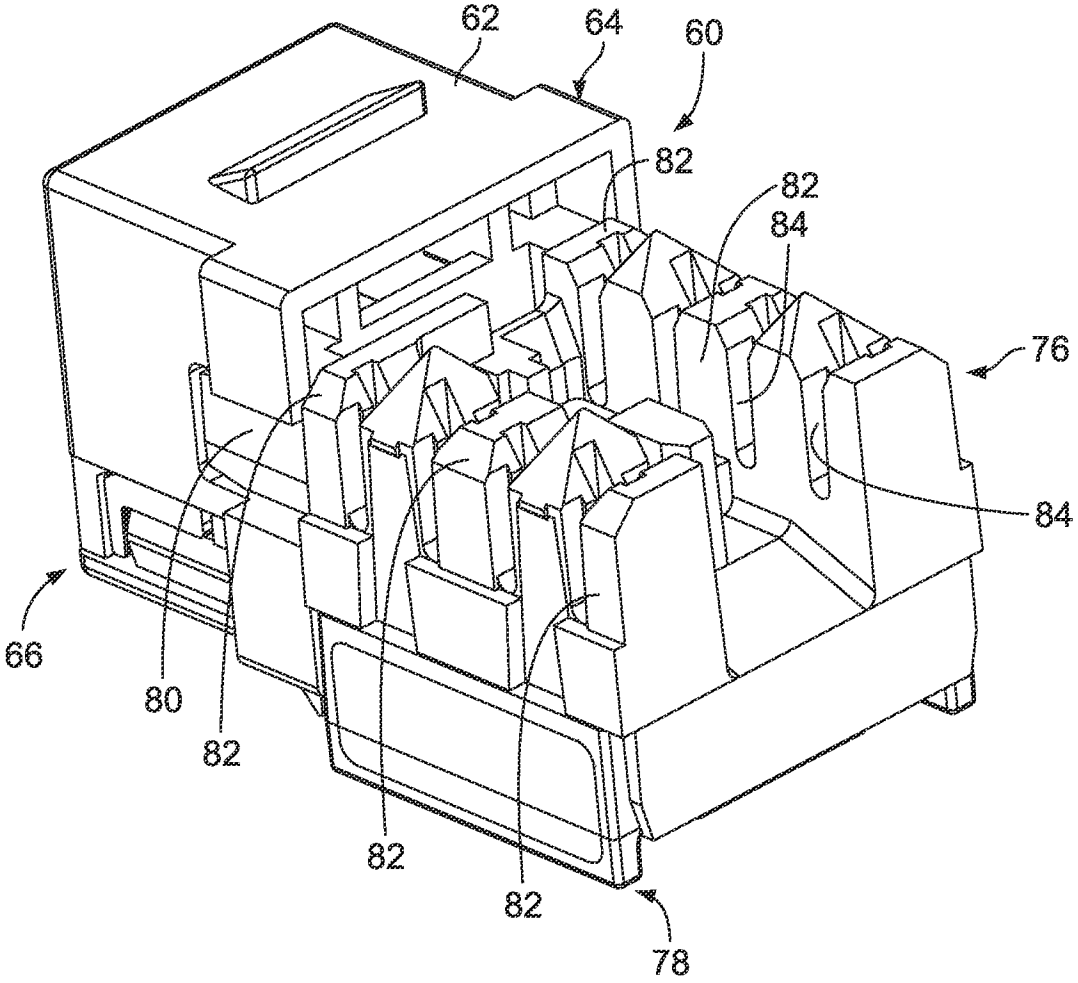
FIG. 6 illustrates a rear perspective view of the vertical style communication module of FIG. 5.
Figure 7:
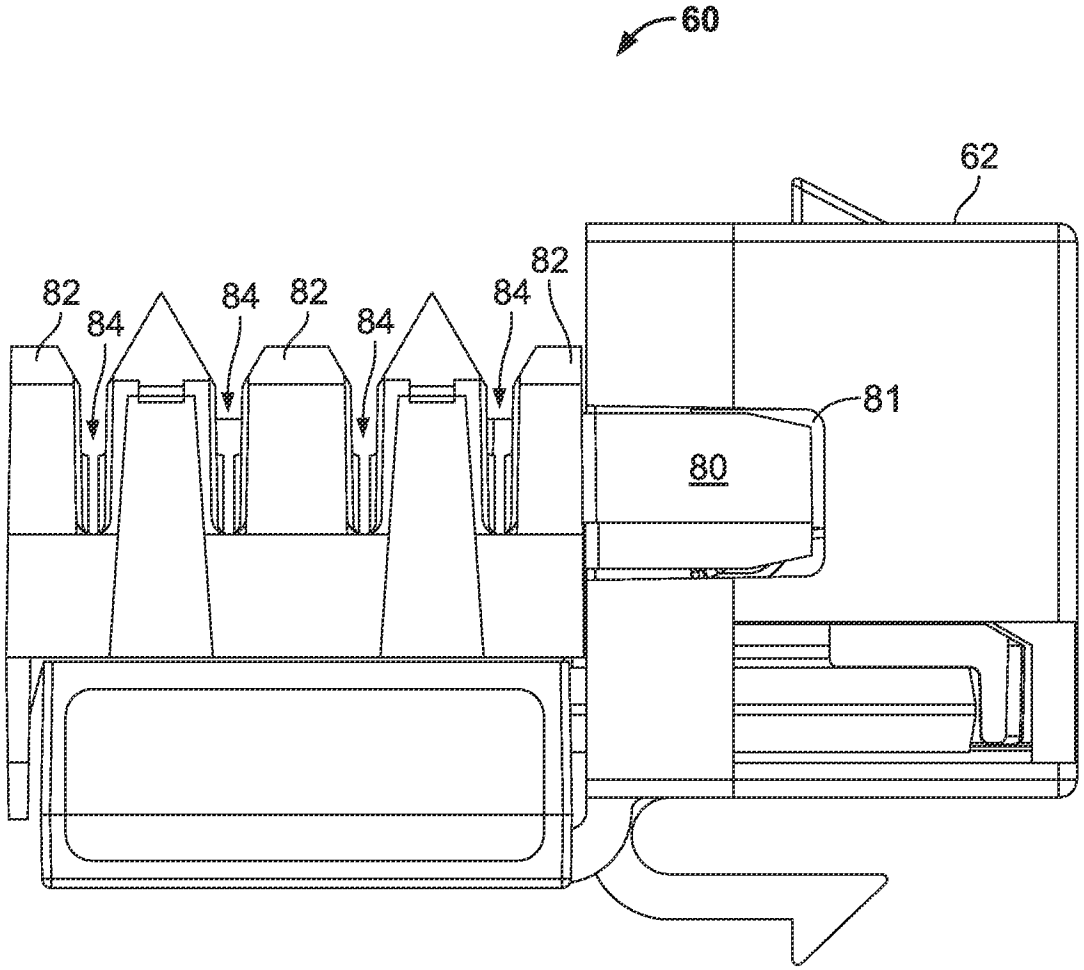
FIG. 7 illustrates a side view of vertical style communication module of FIG. 5.
Figure 8:
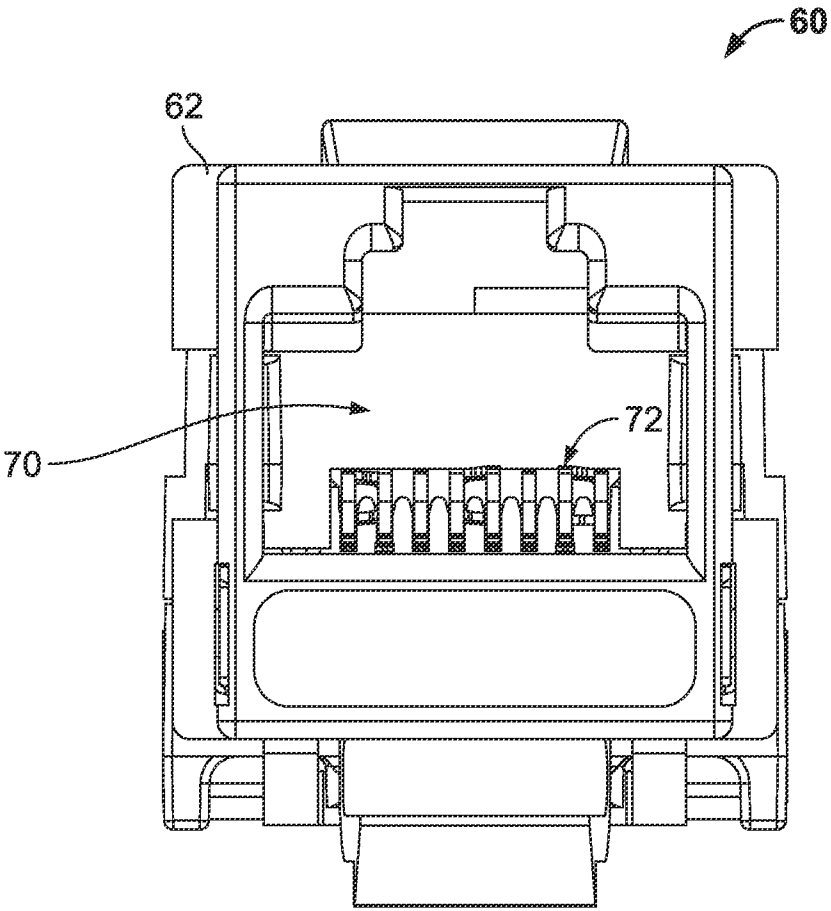
FIG. 8 illustrates an end view of the vertical style communication module of FIG. 5.

Turning to FIG. 4, a cross-sectional view of the tool 10 is provided. The base 12 includes a seat 56 that is capable of fitting both a vertical style communication module and a horizontal style communication module. The base 12 defines a pocket 58 that can receive a vertical style communication module.

FIGS. 5-10 illustrate an example vertical style communication module 60 in accordance with the principles of the present disclosure. The vertical style communication module 60 can include a main body 62 with a first end 64 and a second end 66. The vertical style communication module 60 can include a plurality of insulation displacement connectors 68 (e.g., connection terminations) mounted at the first end 64 of the main body 62. In the examples shown, eight insulation displacement connectors 68 are shown. The main body 62 of the vertical style communication module 60 can define a port 70 at the second end 66 thereof. The vertical style communication module 60 includes eight mating contacts 72 mounted on a support member 74. The insulation displacement connectors 68 can be housed within first and second housing pieces 76, 78. The first housing piece 76 can include latches 80 for latchingly engaging opposing side latching grooves 81 of the vertical style communication module 60.

The vertical style communication module 60 further includes a plurality of upright walls 82 that each have a receiving slot 84. In certain examples, wires of a cable can be placed in the vertical style communication module 60. That is, the wires can be laced within the receiving slots 84 of the vertical style communication module 60. In certain examples, the wires can be held by the vertical style communication module 60 parallel to each other in a lateral direction. The plurality of upright walls 82 are arranged in parallel to each other. The insulation displacement connectors 68 are mounted in the receiving slots 84, respectively. Each of the insulation displacement connectors 68 is electrically connected with the mating contact 72 in the main body 62.

Figure 9:
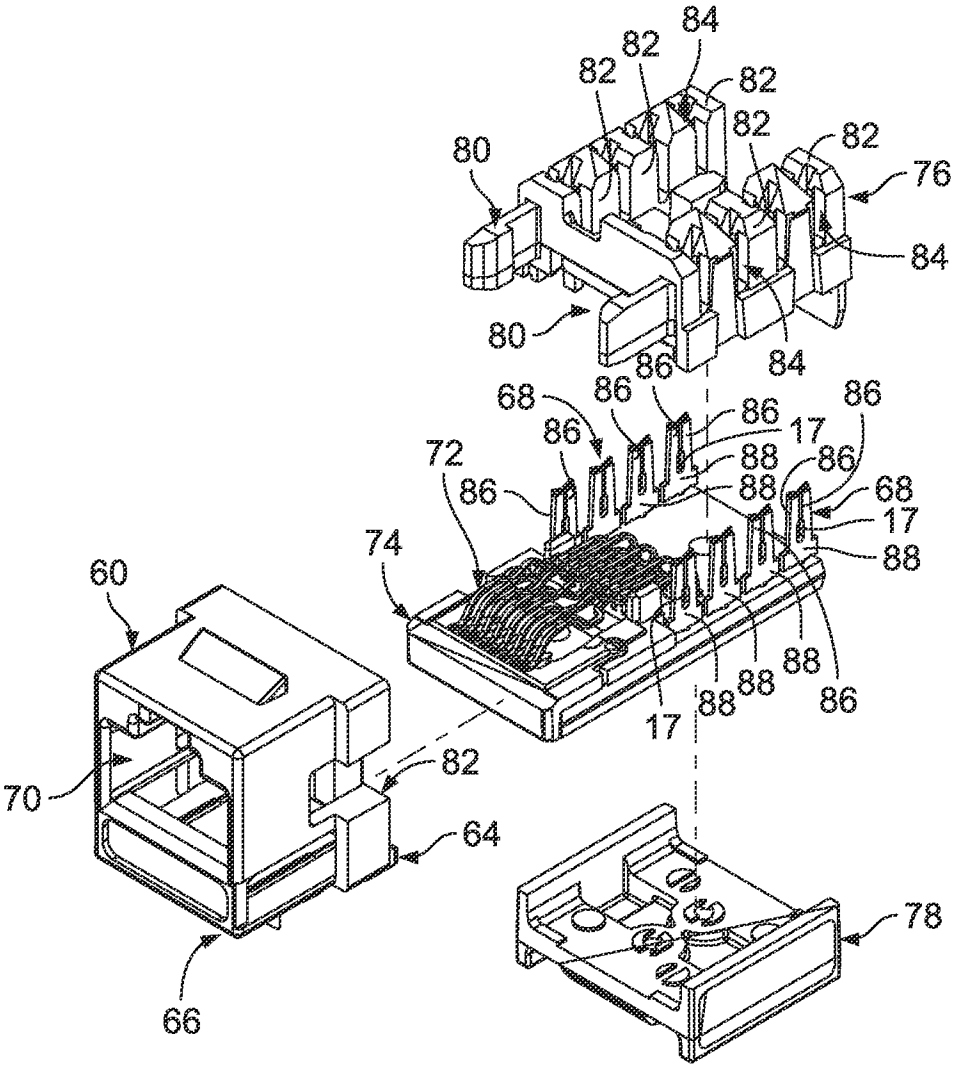
FIG. 9 illustrates an exploded view of the vertical style communication module of FIG. 5.
Figure 10:
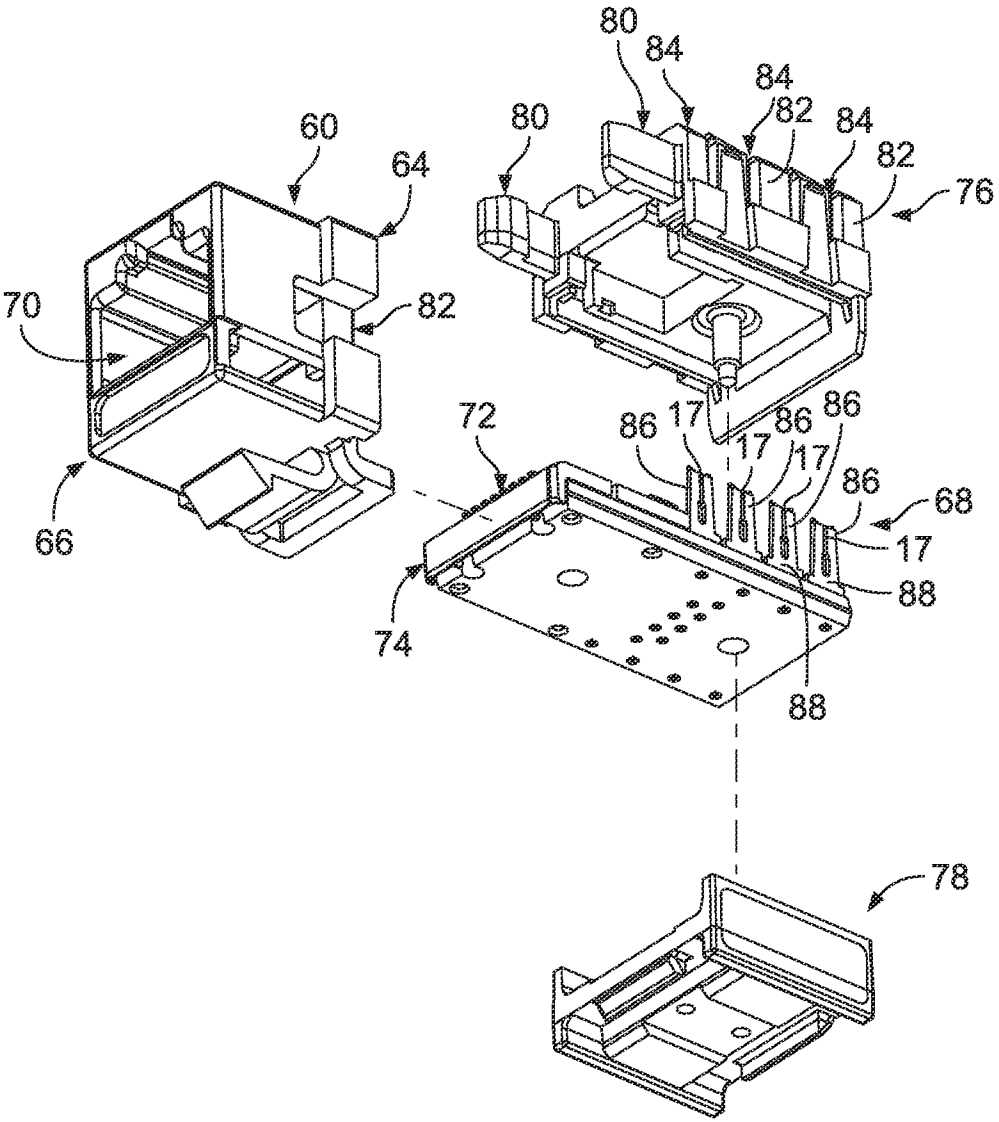
FIG. 10 illustrate a bottom exploded view of the vertical style communication module of FIG. 9.
Figure 12:
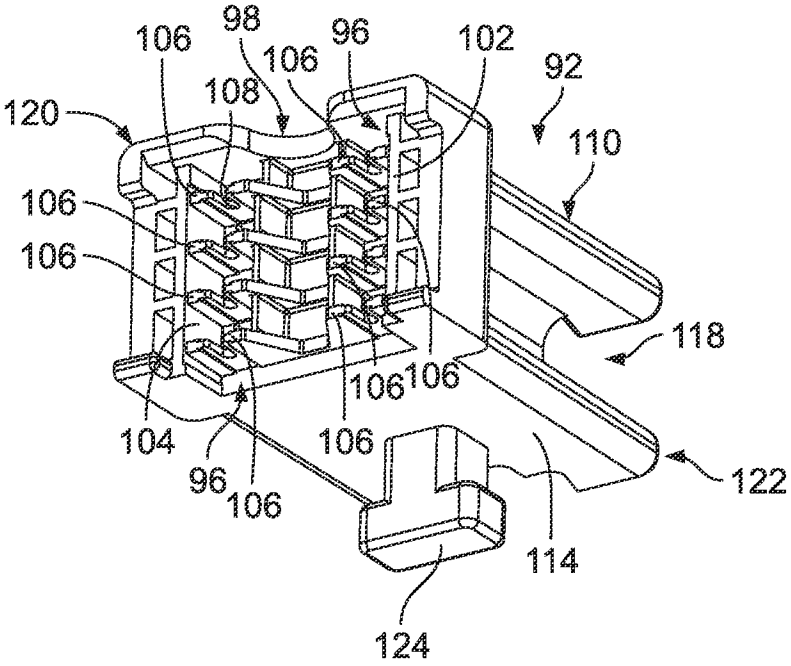
FIG. 12 illustrates a bottom perspective view of the termination device of FIG. 11.
Figure 11:
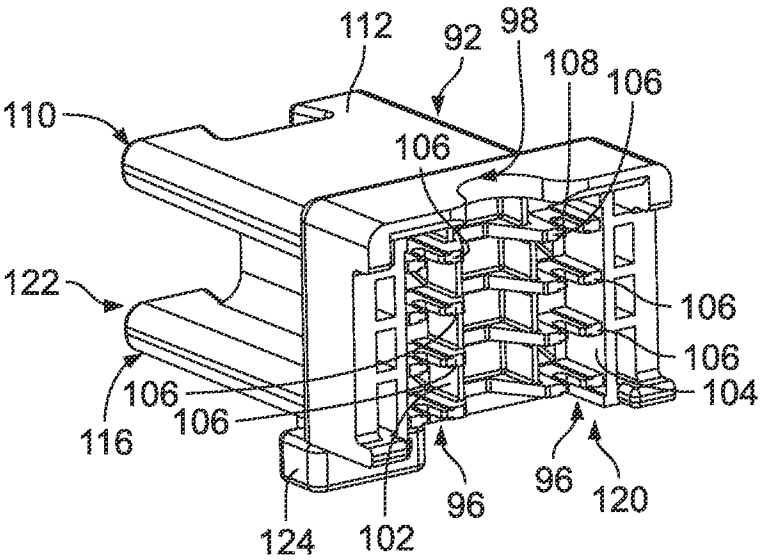
FIG. 11 illustrates a perspective view an example termination device in accordance with the principles of the present disclosure.
Figure 13:
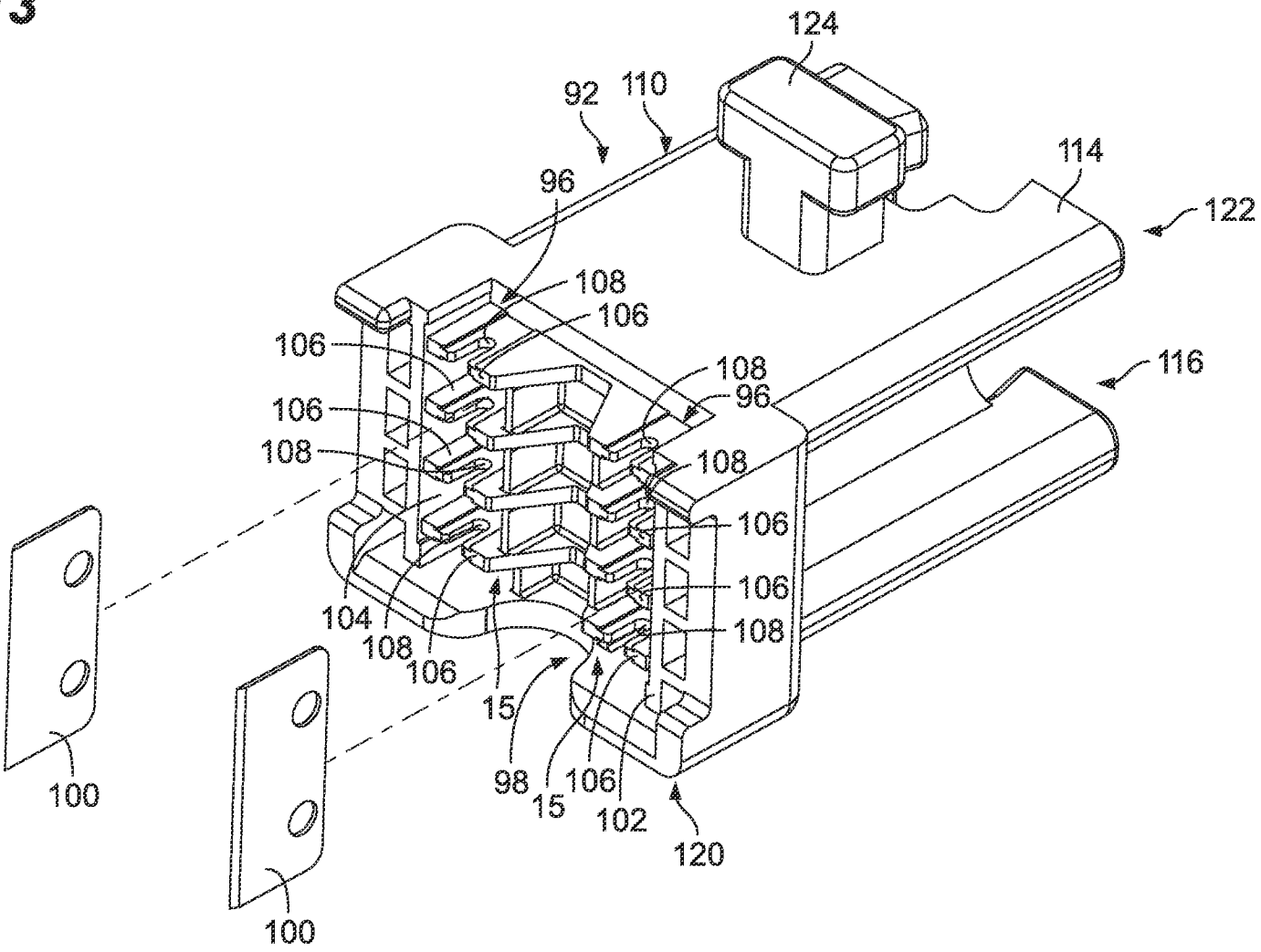
FIG. 13 illustrates another perspective view of the termination device of FIG. 11 showing cutting apparatuses prior to being inserted into the termination device.
Figure 14:
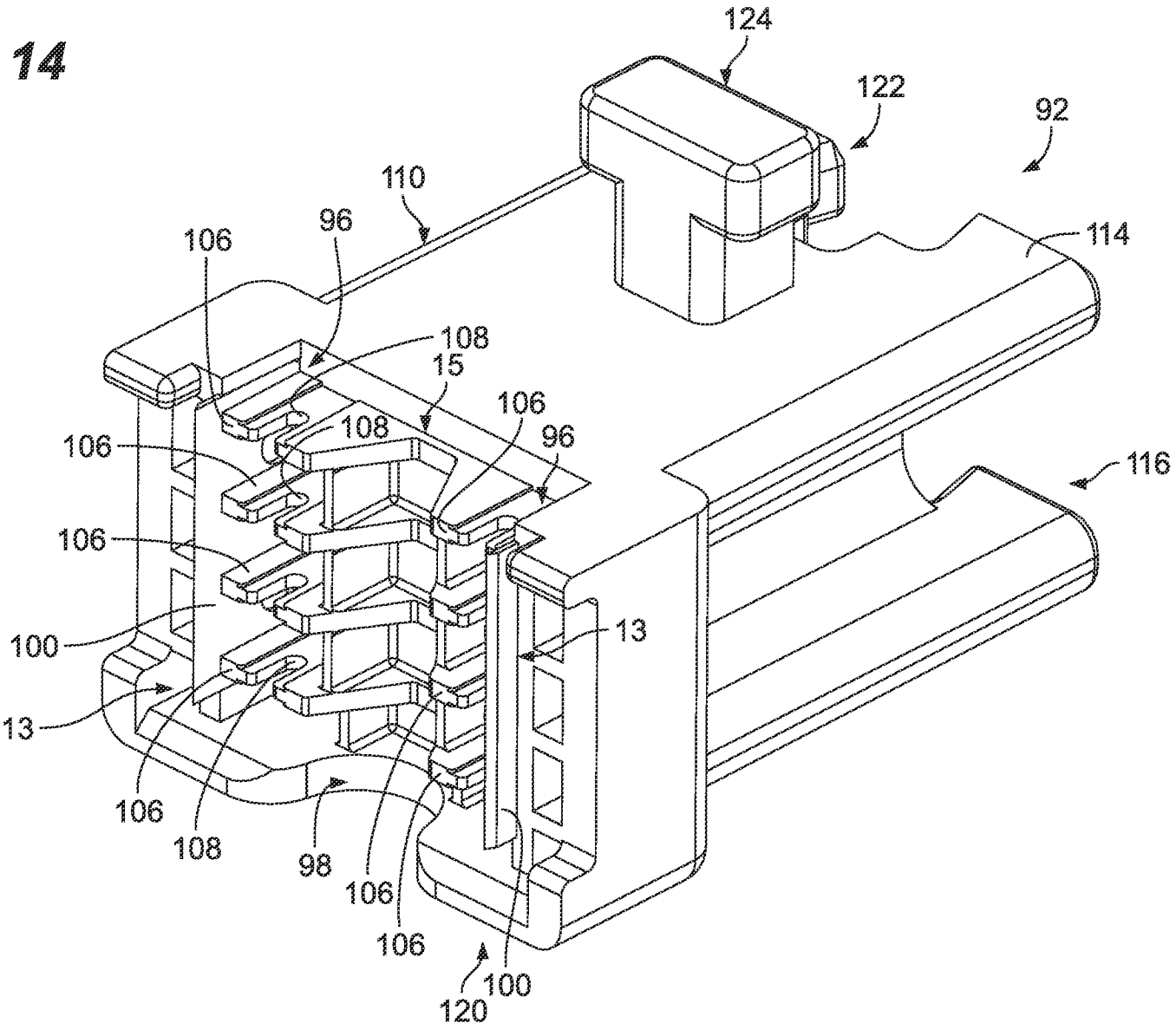
FIG. 14 illustrates a perspective view of the termination device with the cutting apparatus of FIG. 13 mounted therein.
Figure 15:
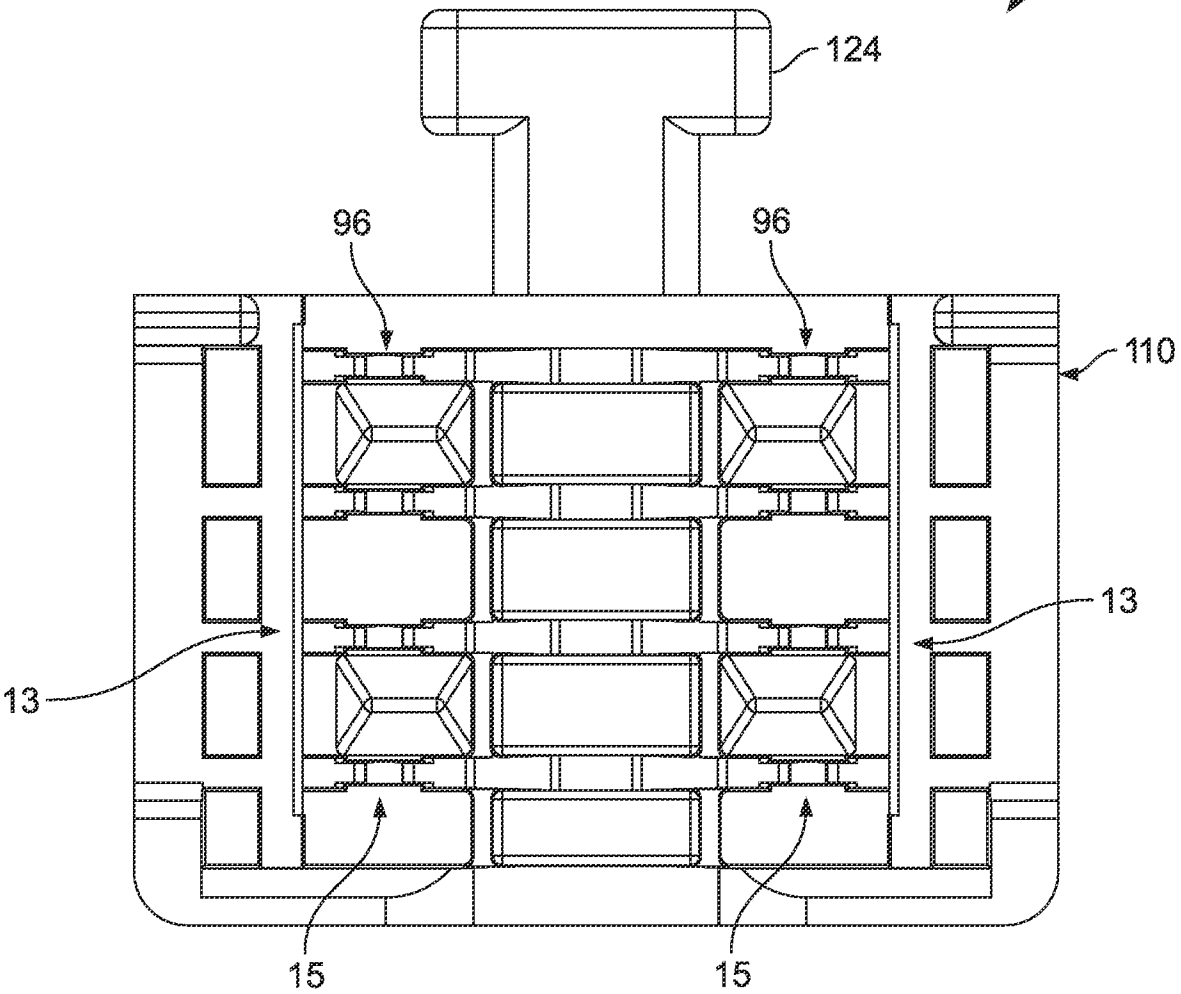
FIG. 15 illustrates a top view of the termination device of FIG. 11.
Figure 17:
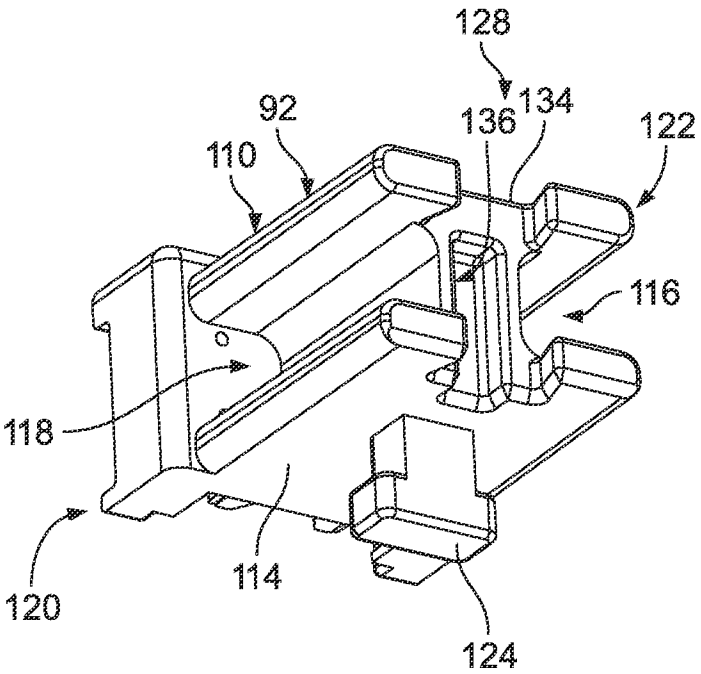
FIG. 17 illustrates a bottom perspective view of the termination device of FIG. 16.
Figure 16:
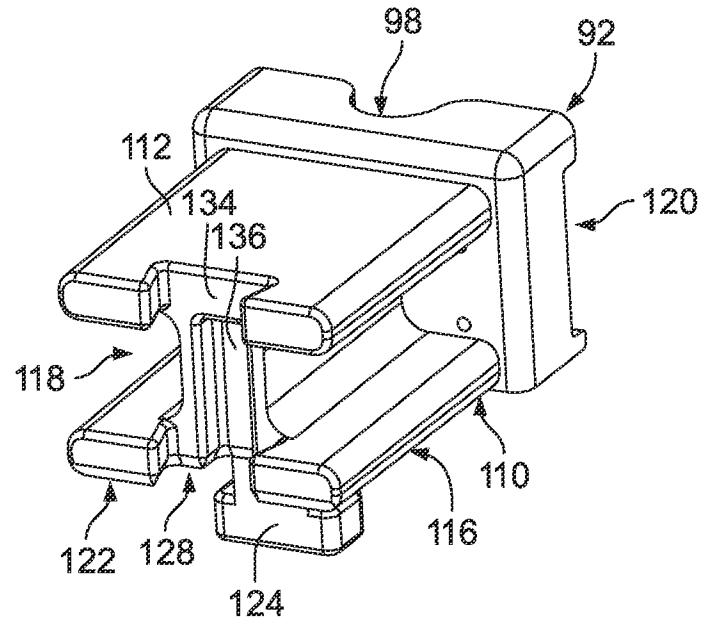
FIG. 16 illustrates a rear perspective view of the termination device of FIG. 11.

As shown in FIGS. 9-10, each of the insulation displacement connectors 68 comprises a pair of connection arms 86 extending from a base 88. Wires of a cable can be placed and held between the two connection arms 86 of the insulation displacement connectors 68 to electrically connect the wires to the insulation displacement connectors 68, respectively. The vertical style communication module 60 can be positioned within the pocket 58 of the base 12 such that the port 70 of the vertical style communication module 60 faces a bottom 90 (see FIG. 4) of the pocket 58. In certain examples, the insulation displacement connectors 68 can be oriented 90 degrees relative to the port 70. When using the tool 10 to terminate wires of a cable to the vertical style communication module 60, a termination device 92 can be added to the slider 18.

Referring to FIGS. 11-17, an example termination device 92 is illustrated for use with a jack, for example, the vertical style communication module 60.

In certain examples, the termination device 92 can include a wire cutting portion 13 (see FIG. 14) and a wire pushing portion 15.

In other examples, the termination device 92 includes a lacing fixture 94 (e.g., a termination head, a wire holding portion) configured to hold a plurality of wires of a cable until terminated to the vertical style communication module 60 and trimmed. The example lacing fixture 94 will be described below with reference to FIGS. 36-39.

The termination device 92 can be arranged and configured to terminate wires of a cable to the plurality of insulation displacement connectors 68 of the vertical style communication module 60. The termination device 92 includes two terminating segments 96 positioned parallel to each other. During use, the terminating segments 96 are configured to separately push a plurality of wires held by the vertical style communication module 60. A cable holding segment 98 is positioned between the two terminating segments 96 to hold a cable.

The termination device 92 includes a cutting apparatus 100 made of metal, such as, stainless steel, copper, etc. The cutting apparatus 100 is positioned within the wire cutting portion 13 of the termination device 92. In certain examples, the cutting apparatus 100 is a separate part from the termination device 92.

The termination device 92 includes a first support wall 102 and a second support wall 104 parallel to the first support wall 102. A plurality of wire pushing walls 106 are positioned between the first and second support walls 102, 104. Each of the wire pushing walls 106 is adapted push the wires into a holding portion 17 formed between the two connection arms 86 of the insulation displacement connectors 68 of the vertical style communication module 60 to electrically connect the wires to the holding portions 17, respectively, during termination. Each of the wire pushing walls 106 define a notch 108 for receiving the insulation displacement connectors 68 of the vertical style communication module 60.

The cutting apparatus 100 can be provided in the two terminating segments 96 adjacent the first and second support walls 102, 104. The cutting apparatus 100 is configured to cut off parts or end portions of wires of a cable after the wires have been respectively terminated to the insulation displacement connectors 68.

The termination device 92 has a body 110 having a top surface 112, a bottom surface 114, a first side 116, a second side 118, a first end 120 and a second end 122. The termination device 92 can also include a protrusion 124 that extends from the bottom surface 114 of the body 110.

Figure 18:
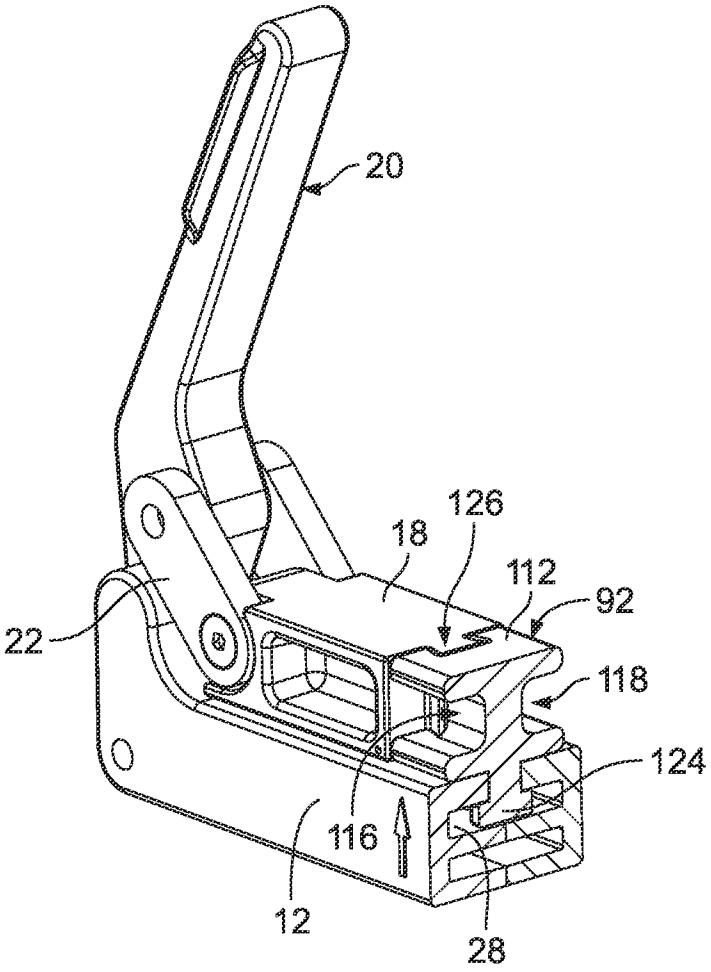
FIG. 18 illustrates a cross-sectional view of the termination device of FIG. 11 mounted on the termination tool and connected to the slider of FIG. 1.

Referring to FIG. 18, when the termination device 92 is mounted on the seat 56 of the base 12, the protrusion 124 is adapted to be inserted within the guide slot 28. The protrusion 124 can be inserted within the guide slot 28 such that the termination device 92 can be moved linearly on the seat 56. The termination device 92 is shown attached to the slider 18 by a coupling arrangement 126. The coupling arrangement 126 is provided for releasably connecting the slider 18 to the termination device 92. That is, the coupling arrangement 126 provides a detachable interlocking connection between the slider 18 and the termination device 92.

In certain examples, the detachable interlocking connection is a slidable detachable interlocking connection. In certain examples, the slidable detachable interlocking connection includes a tongue and groove type of connection. In certain examples, the tongue and groove form a dovetail connection. In certain examples, the detachable interlocking connection is a snap-fit connection. It will be appreciated that the coupling arrangement 126 in the form of a detachable interlocking connection may be configured in a variety of different configurations as long as it allows the slider 18 to be removably coupled to the termination device 92.

Figure 19:
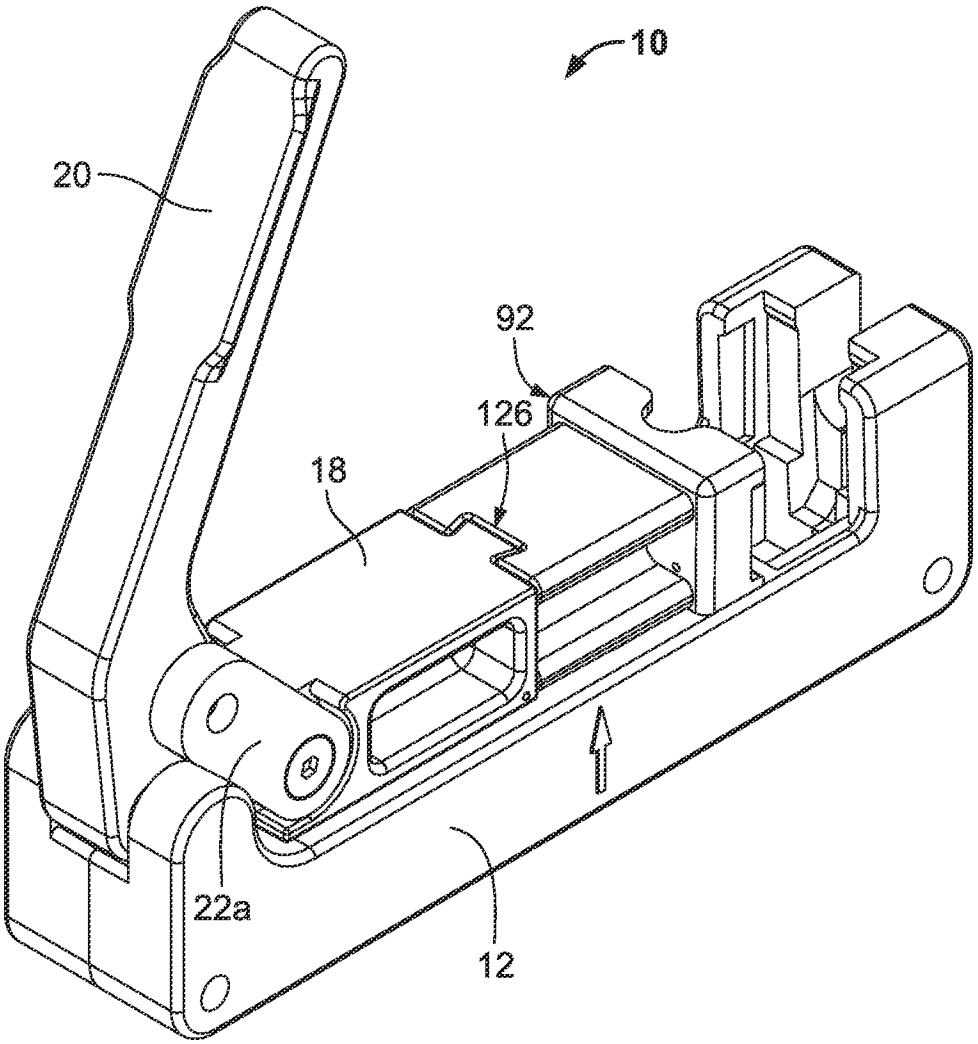
FIG. 19 illustrates a perspective view of the termination tool of FIG. 1 with the termination device of FIG. 11 mounted thereon.
Figure 20:
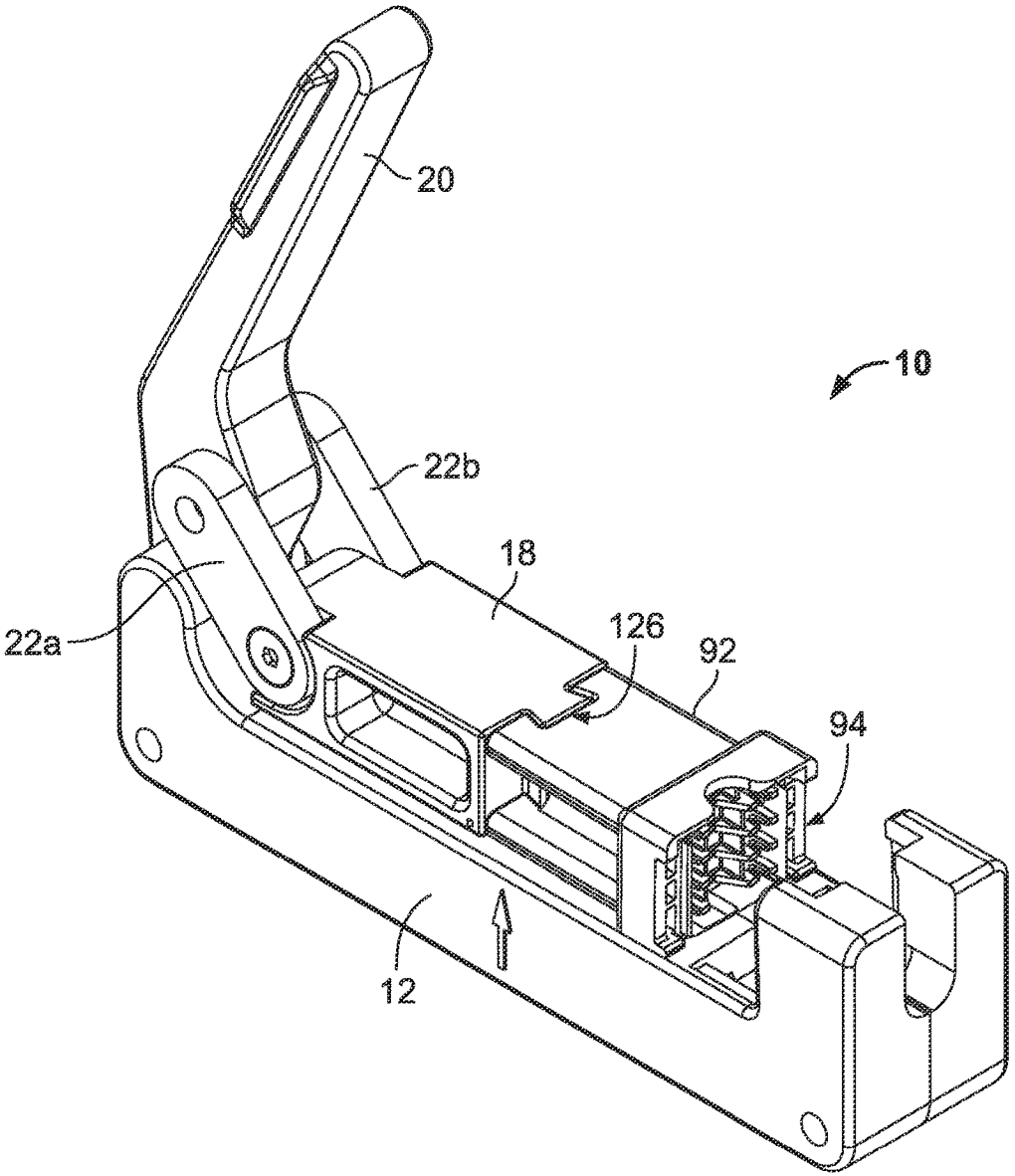
FIG. 20 illustrates another perspective view of the termination tool of FIG. 19.

Referring to FIGS. 19-20, the coupling arrangement 126 includes intermating dovetail features between the slider 18 and the termination device 92. The dovetail feature in the form of a male feature can include the dovetail tongue portion 48 provided on the slider 18 and a mating dovetail feature in the form of a female feature includes a dovetail receiver 128 (e.g., dovetail groove portion) and is provided at the second end 122 of the termination device 92. The dovetail tongue portion 48 is capable of being received within the dovetail receiver 128 when the coupling arrangement 126 is being connected to provide a dovetail connection between the slider 18 and the termination device 92.

Turning back to FIG. 3, the dovetail tongue portion 48 includes a longitudinal tongue 130 with a pair of angled or sloped surfaces 132 that form a dovetail shape, thereby enabling the dovetail tongue portion 48 to form a connection with the dovetail receiver 128.

In certain examples, the dovetail tongue portion 48 of the slider 18 can slidably mount within a groove 134 defined by the dovetail receiver 128 as the termination device 92 is mounted on the base 12. In certain examples, when the pivotable lever arm 20 is pressed, the slider 18 can engage the second end 122 of the termination device 92 when the termination device 92 is mounted on the base 12 such that the dovetail tongue portion 48 engages the dovetail receiver 128. The termination device 92 reaches its seated position on the base 12 when the protrusion 124 of the termination device 92 engages and bottoms out in the guide slot 28. The protrusion 124 of the termination device 92 allows the termination device 92 to slide freely within the guide slot 28.

When the dovetail tongue portion 48 slidably mounts within the groove 134 of the dovetail receiver 128, the protrusion 52 of the slider 18 can engage a cavity 136 defined in the dovetail receiver 128 of the termination device 92 to help limit the amount of movement between the slider 18 and the termination device 92 when coupled together. The dovetail receiver 128 of the termination device 92 is sized and shaped to mate snugly with the dovetail tongue portion 48 of the slider 18 when slider 18 is mounted to the termination device 92. The slider 18 is adapted to be connected to the termination device 92 as one-piece to operatively function as a pusher. That is, the termination device 92 and the slider 18 can slide together such that the slider 18 becomes a pusher with the termination device 92 to push the wires for terminating the vertical style communication module 60.

Figure 21:
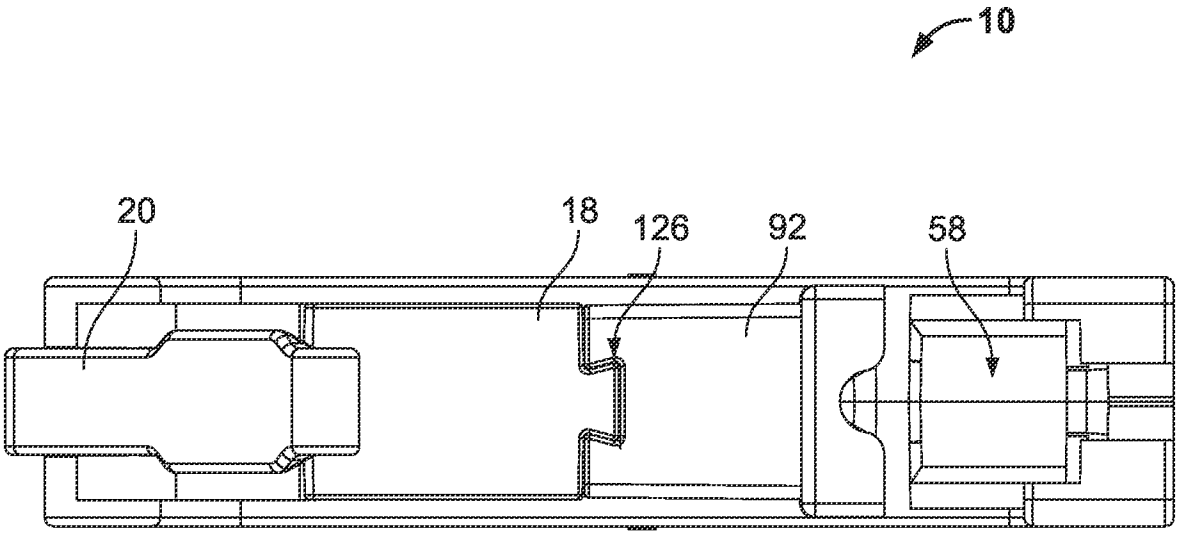
FIG. 21 illustrates a top view of the termination tool of FIG. 19.

Referring to FIG. 21, the base 12 of the tool 10 defines the pocket 58 for receiving the vertical style communication module 60 in a vertical orientation. In certain examples, horizontal style communication modules can be mounted on the base 12 and not engage the pocket 58.

Figure 22:
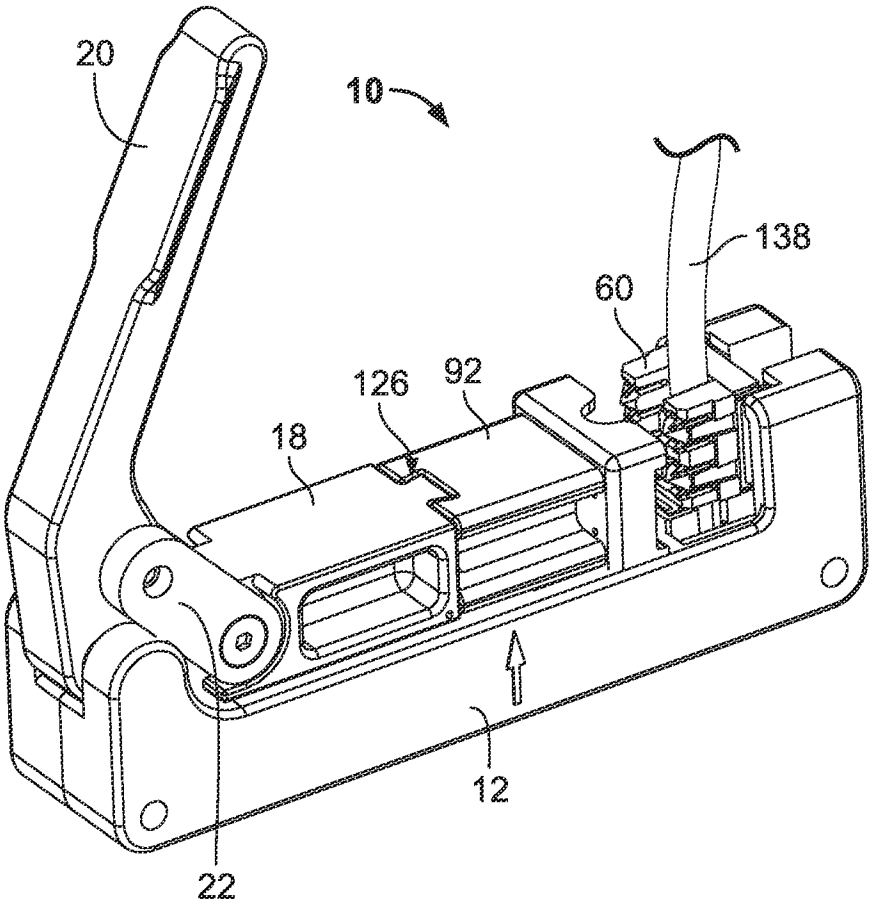
FIG. 22 illustrates a perspective view of the termination tool with the vertical style communication module mounted thereon and the termination device and slider in an initial position prior to termination.
Figure 23:
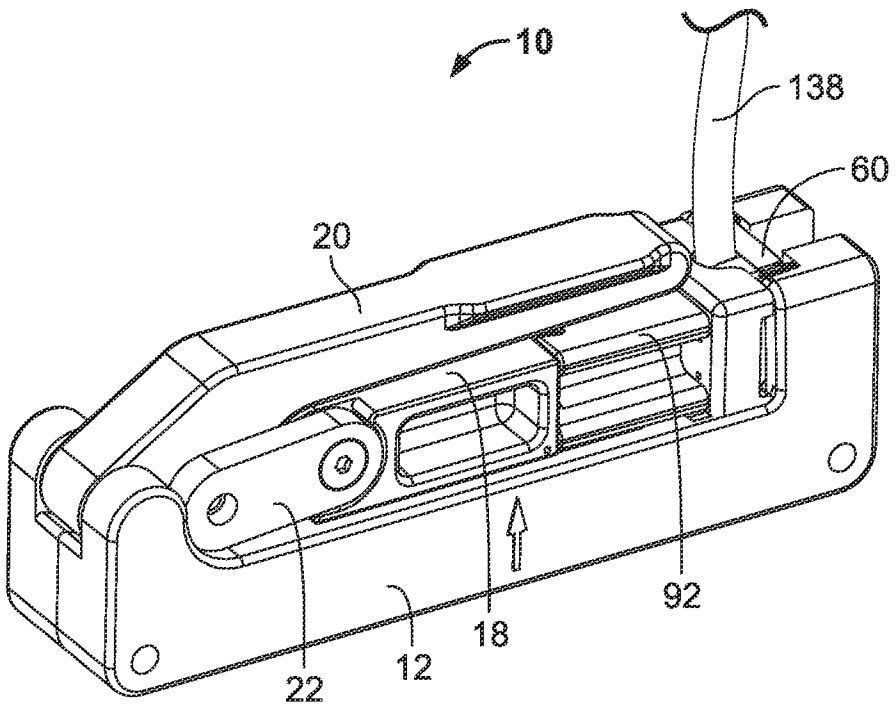
FIG. 23 illustrates a perspective view of the termination tool of FIG. 22 with the pivotable lever arm pressed to move the termination device and slider to a final position to terminate the vertical style communication module.

Referring to FIGS. 22-23, once the vertical style communication module 60 is prepared with a cable 138, the vertical style communication module 60 can be positioned within the pocket 58 of the base 12 such that the port 70 of the vertical style communication module 60 faces the bottom 90 of the pocket 58. The slider 18 and the termination device 92 are configured to be moved between an initial position (as shown in FIG. 22) and a final position (as shown in FIG. 23). In the initial position, the terminating segments 96 are preassembled in an initial engagement state with the plurality of insulation displacement connectors 68 of the vertical style communication module 60.

To terminate the wires of the cable 138, the pivotable lever arm 20 can be pressed so that both the termination device 92 and the slider 18 move toward the vertical style communication module 60. The slider 18 and the termination device 92 moving together as one-piece. The pivotable lever arm 20 can be pressed such that the slider 18 and the termination device 92 are in the final position for terminating and trimming a plurality of wires of the cable 138 to the plurality of insulation displacement connectors 68 of the vertical style communication module 60. Once termination is complete, the pivotable lever arm 20 can be opened and the vertical style communication module 60 can be removed from the tool 10.

Figure 24:
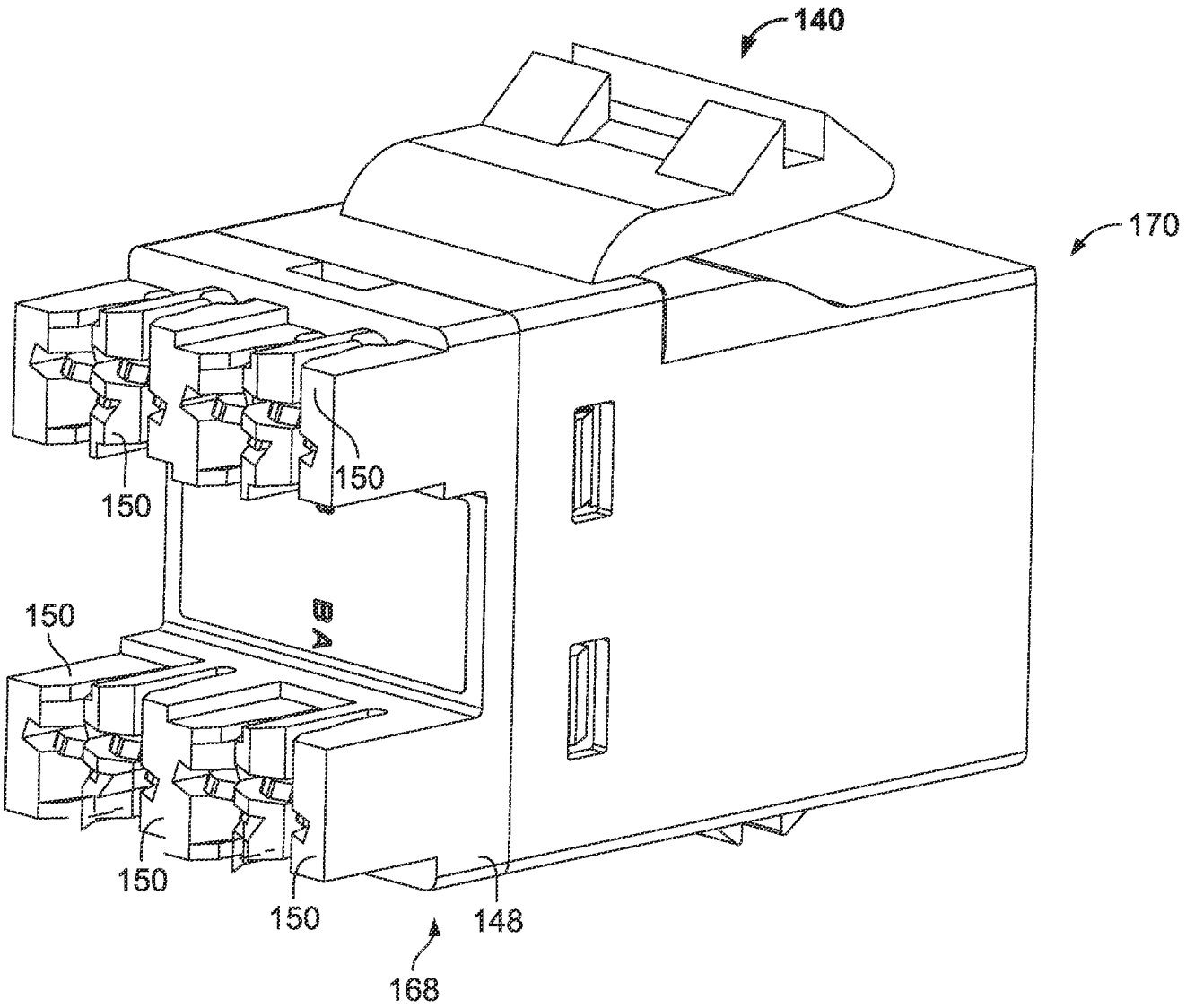
FIG. 24 illustrates a perspective view of a horizontal style communication module in accordance with the principles of the present disclosure.
Figure 25:
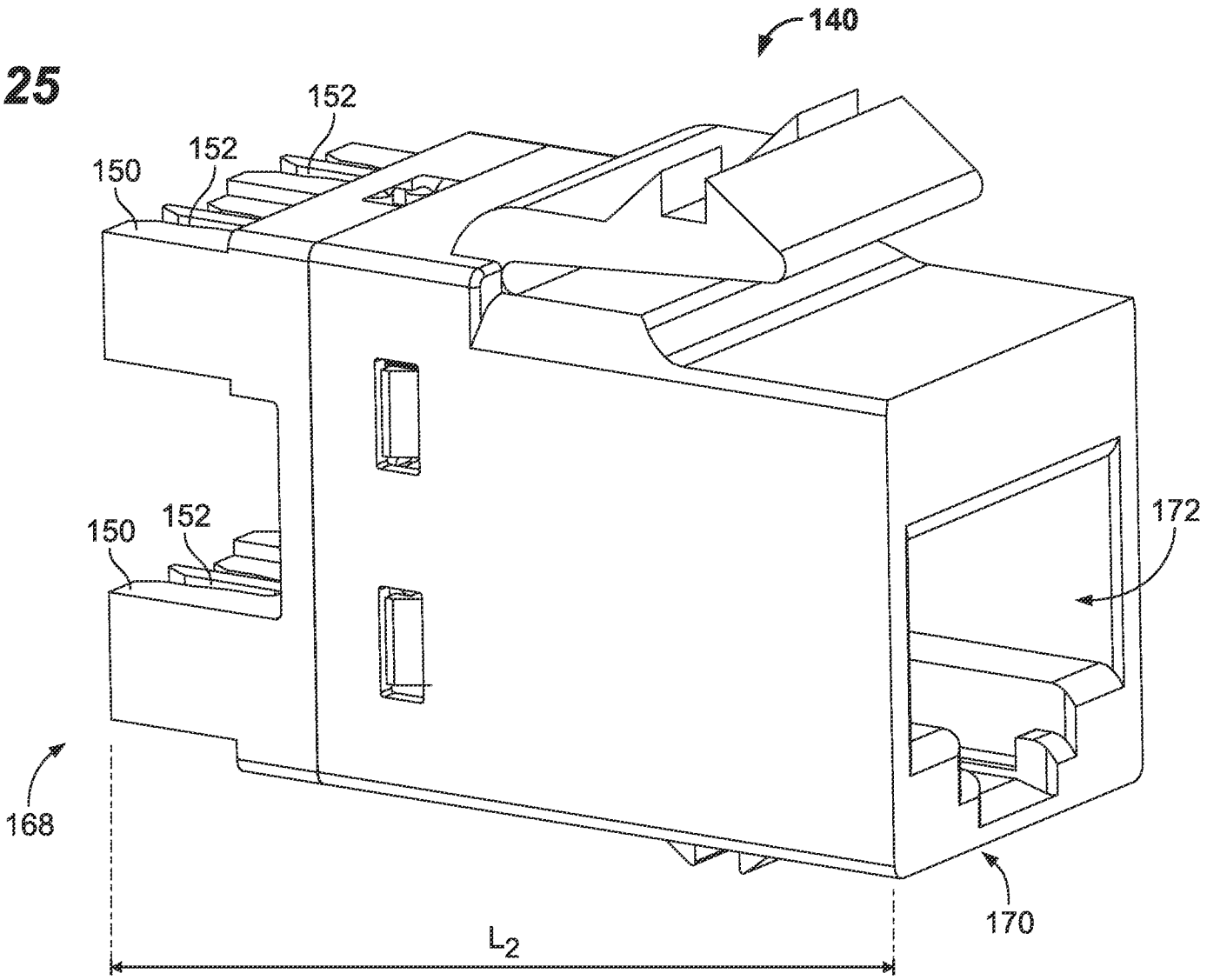
FIG. 25 illustrates another perspective view of the horizontal style communication module of FIG. 24.
Figure 26:
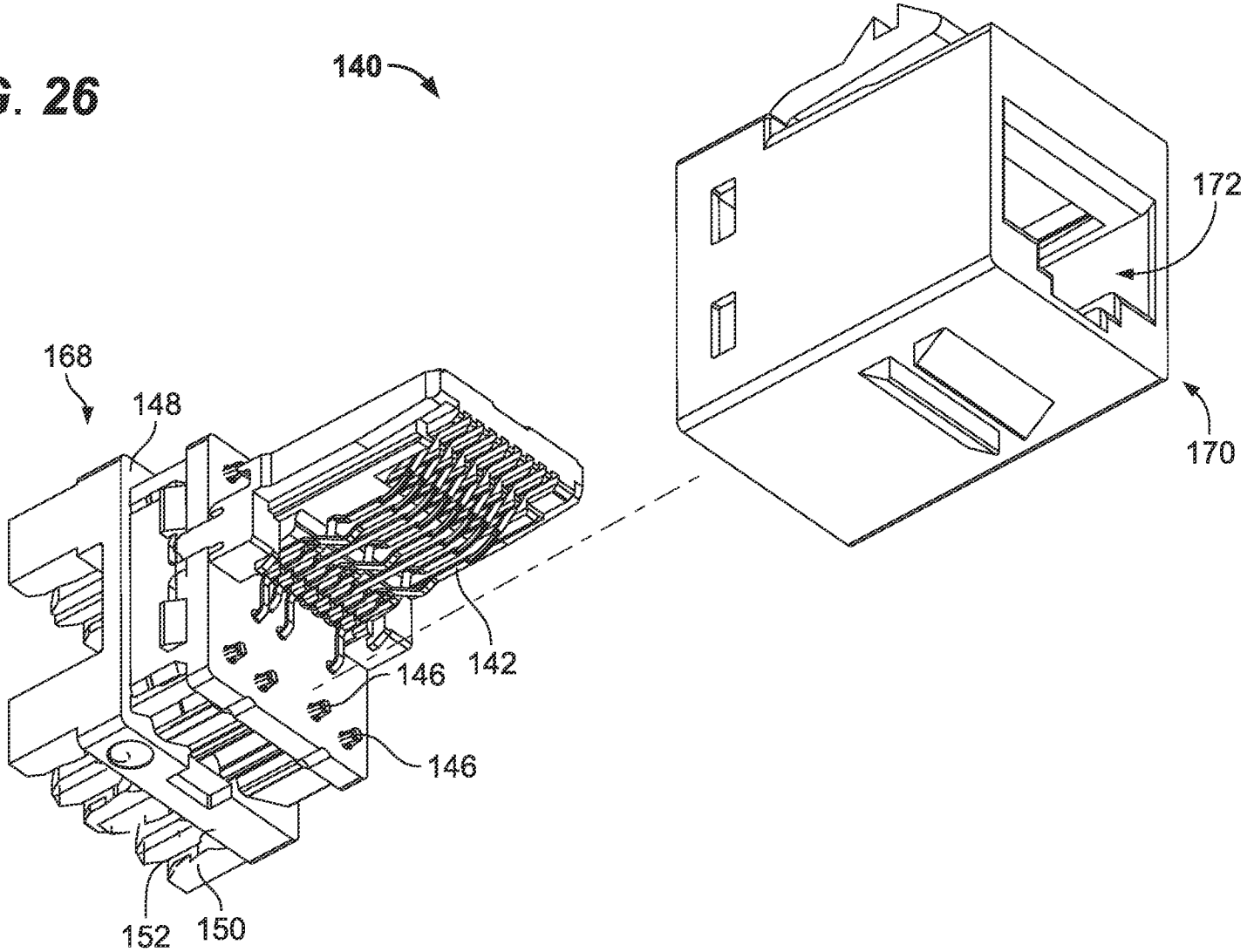
FIG. 26 illustrates another perspective view of the horizontal style communication module showing mating contacts.

Turning to FIGS. 24-26, the tool 10 can also be used to terminate a horizontal style communication module 140 after terminating the vertical style communication module 60 just by removing the i termination device 92 and the vertical style communication module 60.

Figure 33:
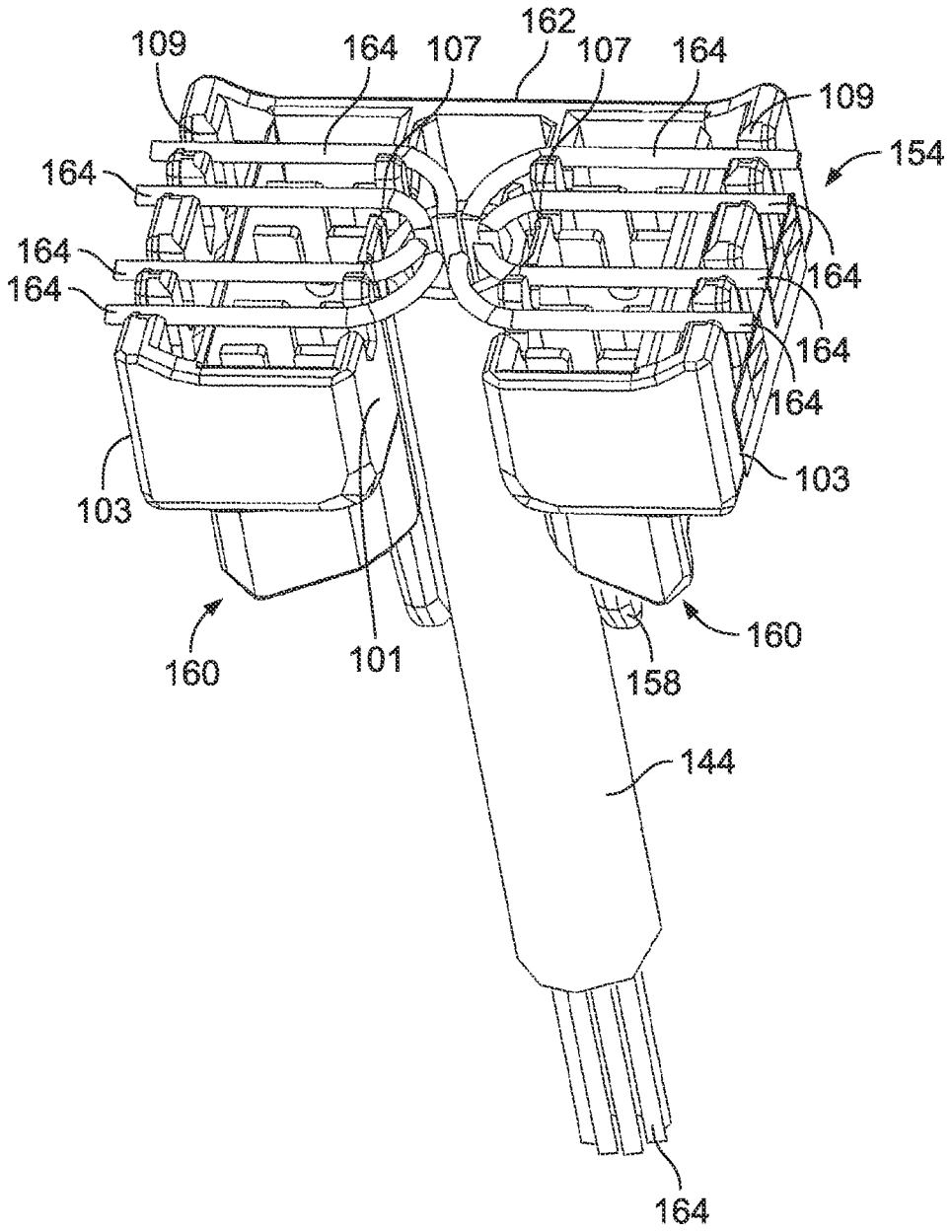
FIG. 33 illustrates a perspective view of the termination device of FIG. 30 on which a cable is mounted.

The horizontal style communication module 140 includes eight mating contacts 142. The horizontal style communication module 140 needs to electrically connect wires of a cable 144 (see FIG. 33) to connection terminations 146 (e.g., insulation displacement connectors) of the horizontal style communication module 140. The connection terminations 146 are partly exposed from a backside of a body 148 of the horizontal style communication module 140, and electrically connected to the mating contacts 142, respectively, in the body 148.

The horizontal style communication module 140 also includes a pair of upright walls 150 arranged parallel to each other and each provide a receiving slot 152. The connection terminations 146 are mounted in the receiving slots 152 and each of the connection terminations 146 is electrically connected with the mating contacts 142 in the body 148, wherein the connection terminations 146 include similar insulation displacement connectors as the vertical style communication module 60.

In certain examples, the slider 18 extends longitudinally along the base 12 a greater distance than the horizontal style communication module 140 positioned thereon. In certain examples, the slider 18 can have a length $L_1$ from end to end that is at least 1.0 times longer than a length $L_2$ of the horizontal style communication module 140. In certain examples, the length $L_1$ of the slider 18 is at least 1.5 times longer than the length $L_2$ of the horizontal style communication module 140. In certain examples, the length $L_1$ of the slider 18 is between 0.25 to 1.5 times longer than the length $L_2$ of the horizontal style communication module 140. In certain examples, the length $L_1$ of the slider 18 is 10%-50% greater than the length $L_2$ of the horizontal style communication module 140.

Figure 27:
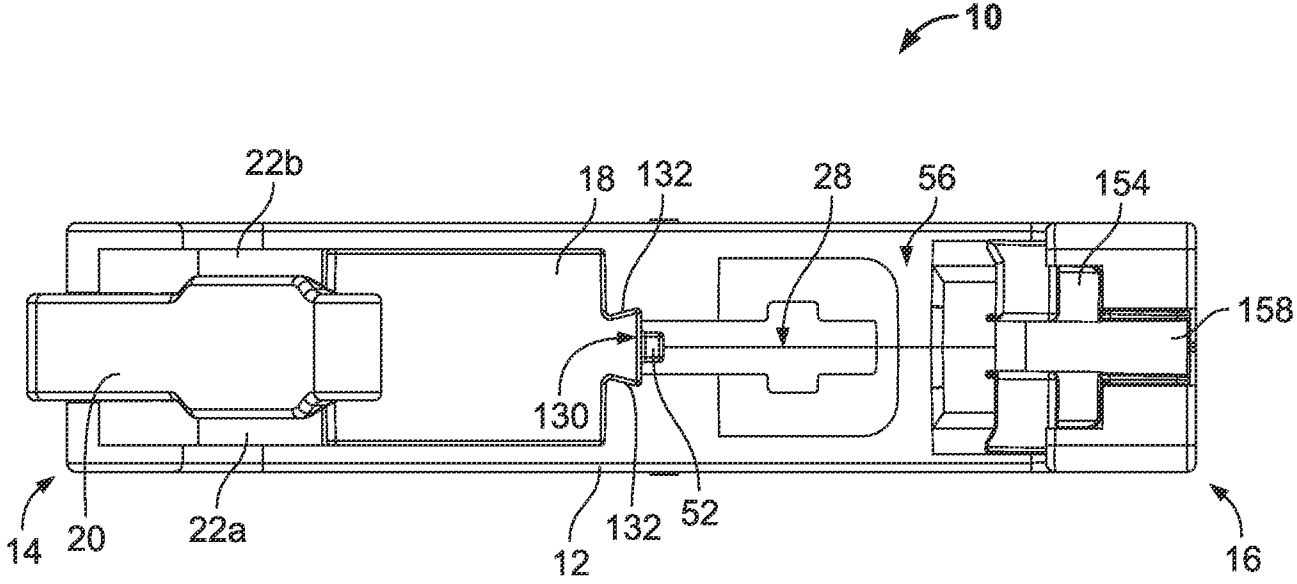
FIG. 27 illustrates a top view of the termination tool of FIG. 1 including another termination device for use with the horizontal style communication module in accordance with the principles of the present disclosure.
Figure 28:
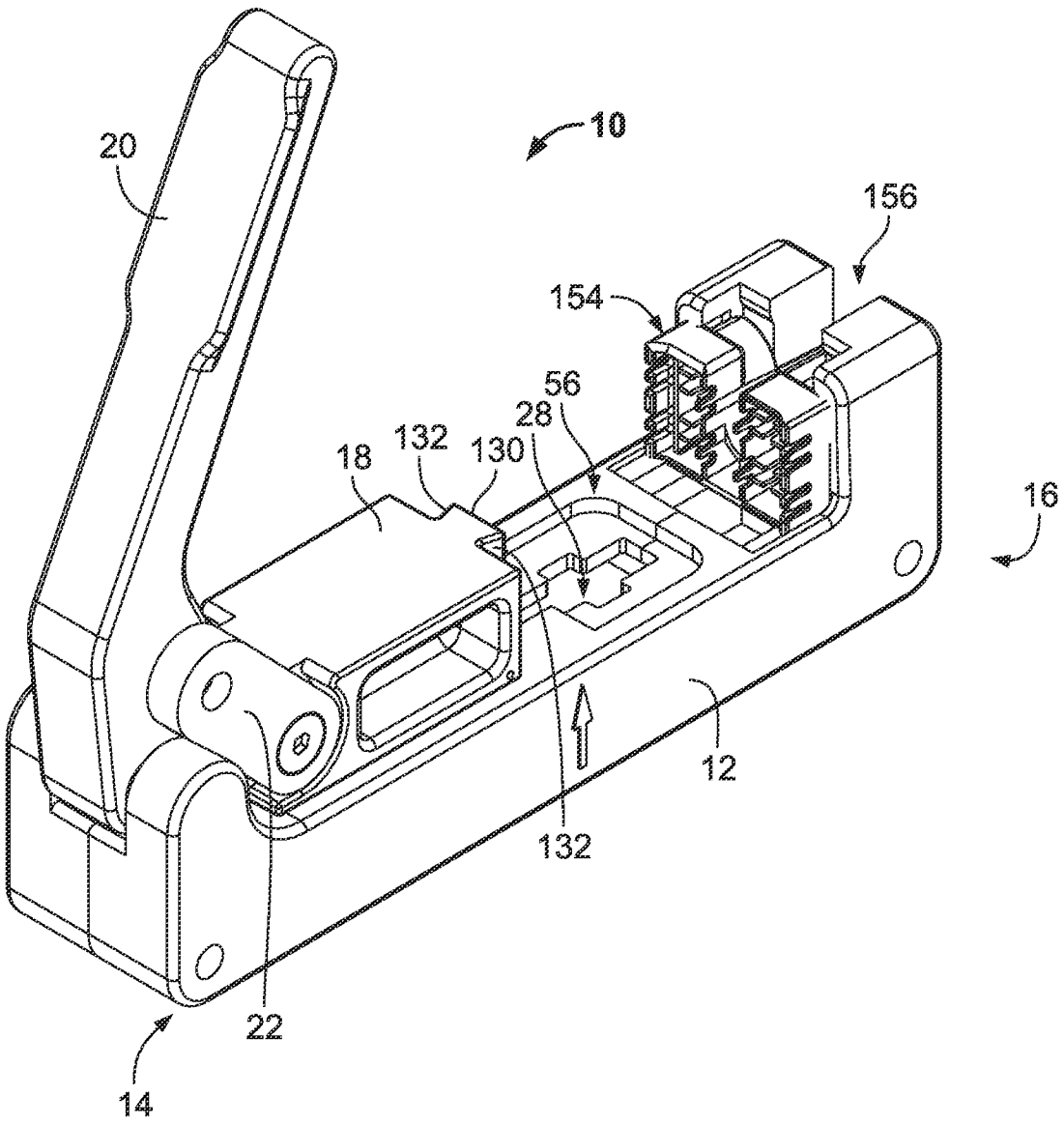
FIG. 28 illustrates a perspective view of the termination tool of FIG. 27.
Figure 29:
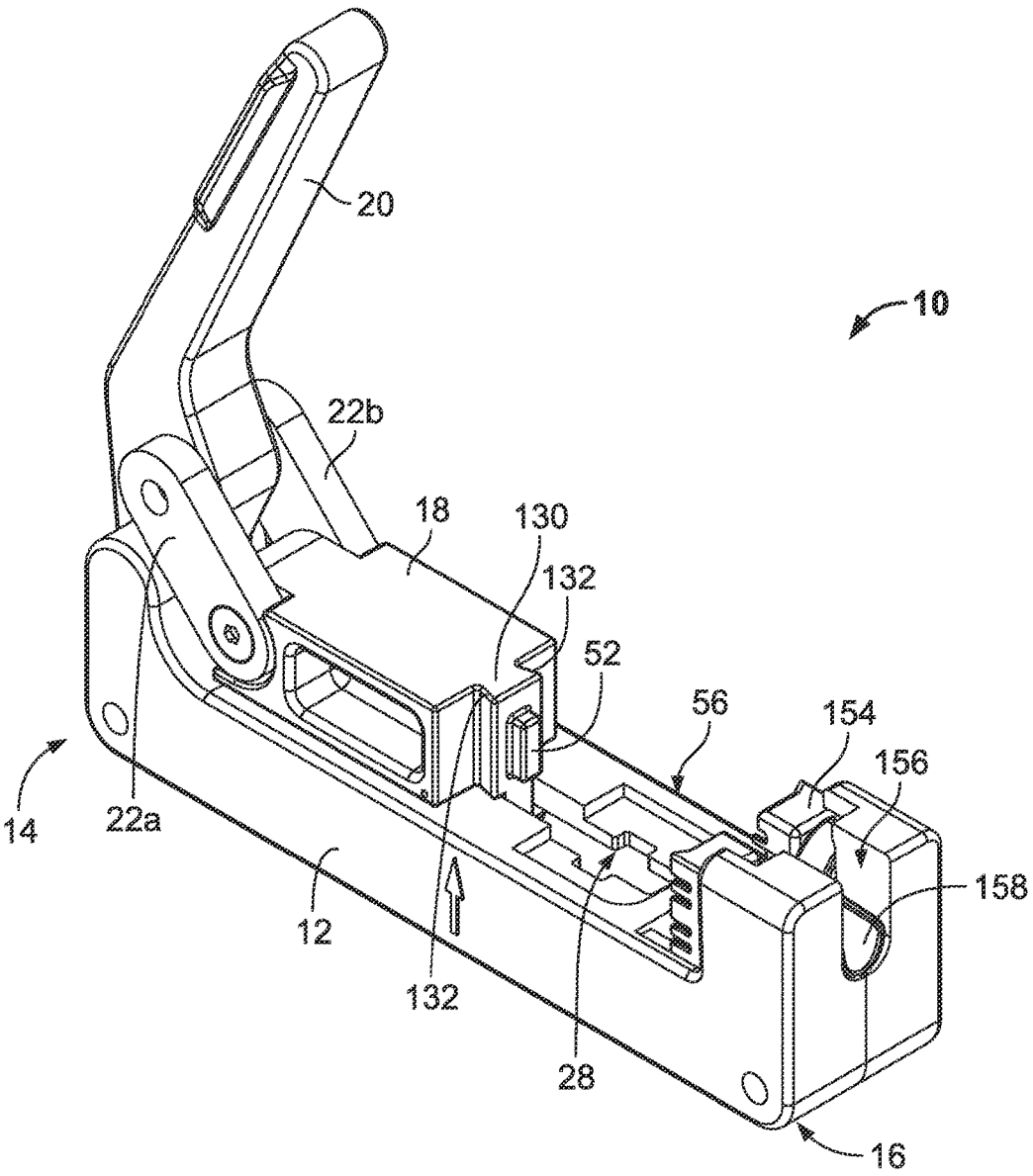
FIG. 29 illustrates another perspective view of the termination tool of FIG. 27.
Figure 30:
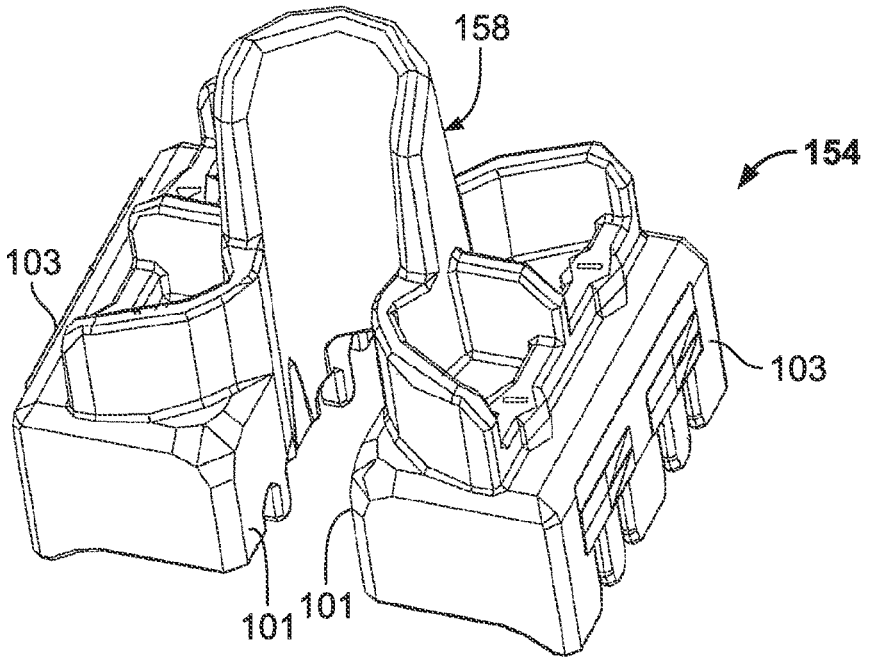
FIGS. 30-31 illustrate perspective views of the termination device of FIG. 27.
Figure 31:
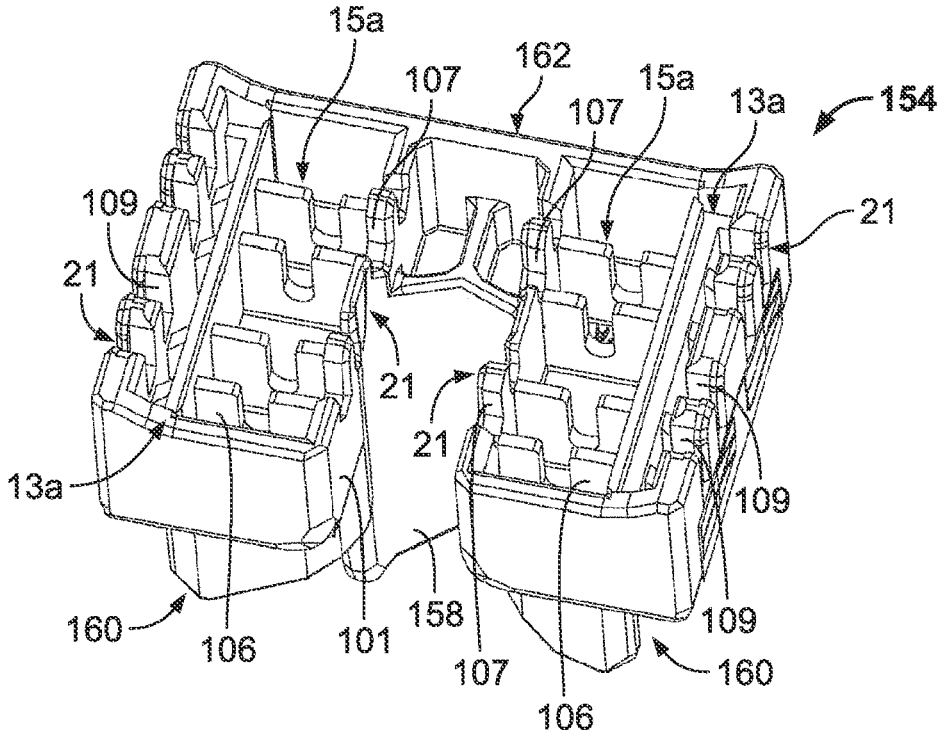
Figure 32:
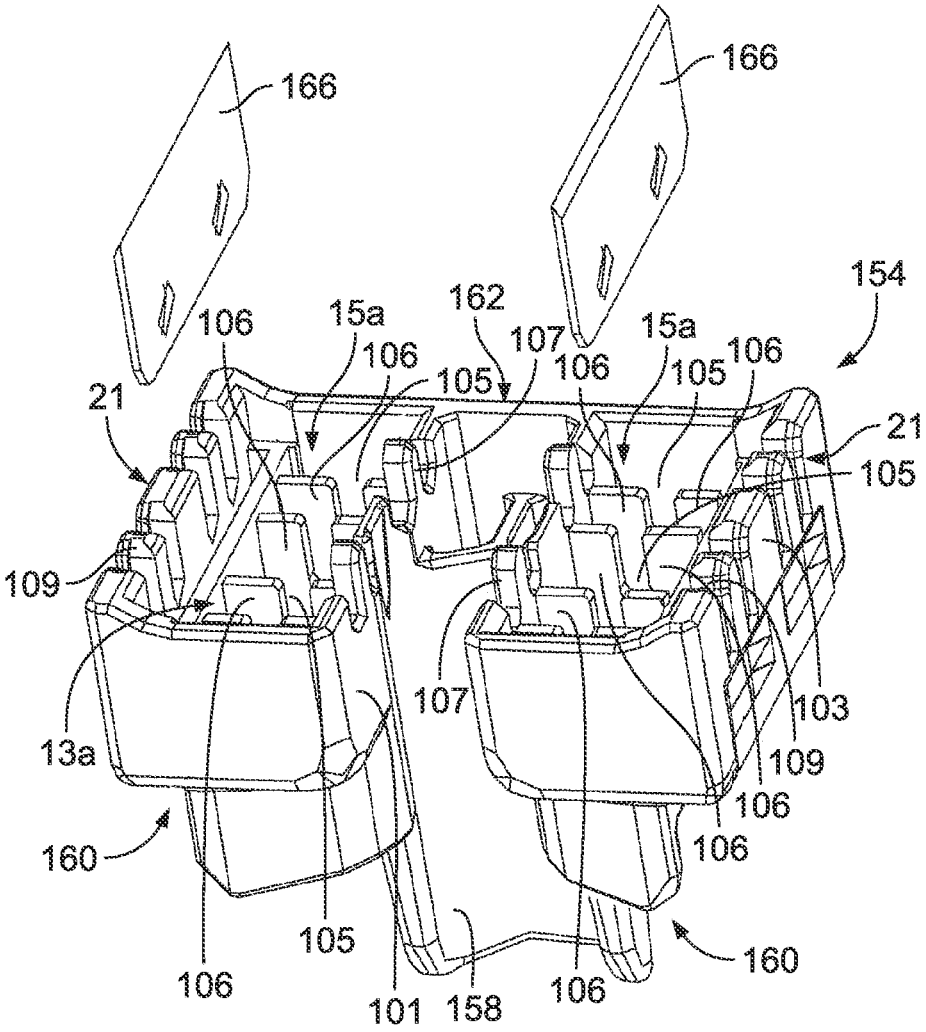
FIG. 32 illustrates a perspective view of the termination device of FIG. 30 showing cutting apparatuses prior to being inserted into the termination device.

Referring to FIGS. 27-29, the tool 10 is configured to be used with another example termination device 154. The termination device 154 includes a wire cutting portion 13*a*, a wire pushing portion 15*a* and also a wire holding portion 21. The termination device 154 can be arranged and configured to terminate the horizontal style communication module 140.

The termination device 154 includes a first support wall 101 and a second support wall 103 parallel to the first support wall 101. The wire pushing portion 15*a* includes a plurality of wire pushing walls 106 that are positioned between the first and second support walls 101, 103. Each of the wire pushing walls 106 is provided with a notch 105 for receiving the insulation displacement connectors of the horizontal style communication module 140. The termination device 154 can also include a cutting apparatus 166 (e.g., blade) provided between the second support wall 103 and the wire pushing walls 106. The notch 105 can be located between the cutting apparatus 166 and the first support wall 101.

The second end 16 of the base 12 of the tool 10 can include a recess 156 for receiving an arc portion 158 of the termination device 154 so that the termination device 154 may be stably placed on the seat 56 of the base 12.

Turning to FIGS. 30-33, the termination device 154 includes two terminating portions 160 and a connection portion 162 connected between the two terminating portions 160. The two terminating portions 160 are arranged parallel to each other in a first direction (longitudinal direction). Each of the terminating portions 160 is configured to separately hold a plurality of wires 164 of the cable 144. The plurality of wires 164 can extend in a second direction (the lateral direction) and parallel to each other. That is, a plurality of first holding slots 107 are formed in a first edge of the first support wall 101, each of the first holding slots 107 is aligned with a respective wire pushing wall 106. Similarly, a plurality of second holding slots 109 are formed in a first edge of the second support wall 103, each of the second holding slots 109 is aligned with a respective wire pushing wall 106. With such configuration, the wires 164 held in the first holding slots 107 and the second holding slots 109 may be rested on the wire pushing walls 106.

The arc portion 158 can be formed on the connection portion 162 and extend in a third direction (a height direction) perpendicular to the first and second directions so as to hold the cable 144 extending in the third direction.

The cutting apparatus 166 may be position in the respective termination portions 160 in the first direction. During termination, the cutting apparatus 166 is configured to cut off end portions of the plurality of wires 164. Examples of such terminating apparatuses and horizontal style communication modules are disclosed in U.S. Pat. No. 10,439,352, entitled, TERMINATING APPARATUS FOR TERMINATING WIRES TO A COMMUNICATION MODULE, which issued on, Oct. 8, 2019, the disclosure of which is herein incorporated by reference in its entirety.

Figure 34:
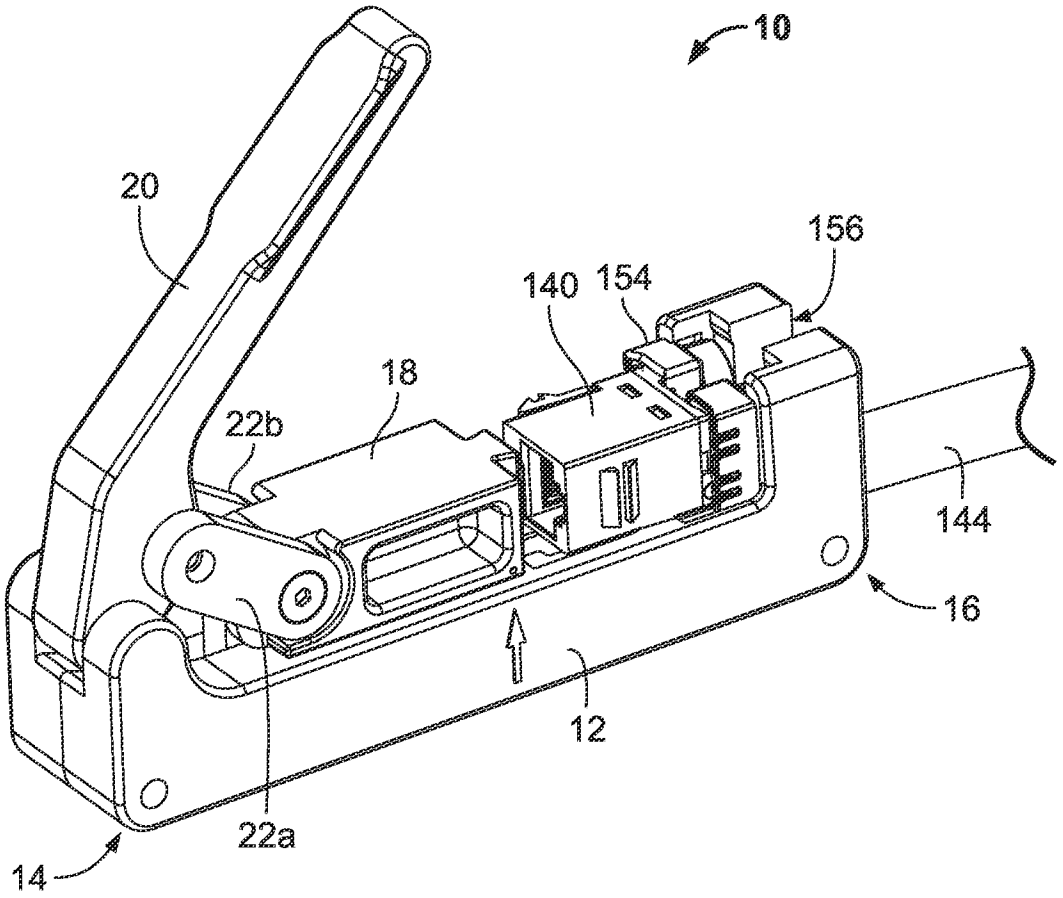
FIG. 34 illustrates a perspective view of the termination device and the horizontal style communication module on the termination tool in an initial position prior to termination.
Figure 35:
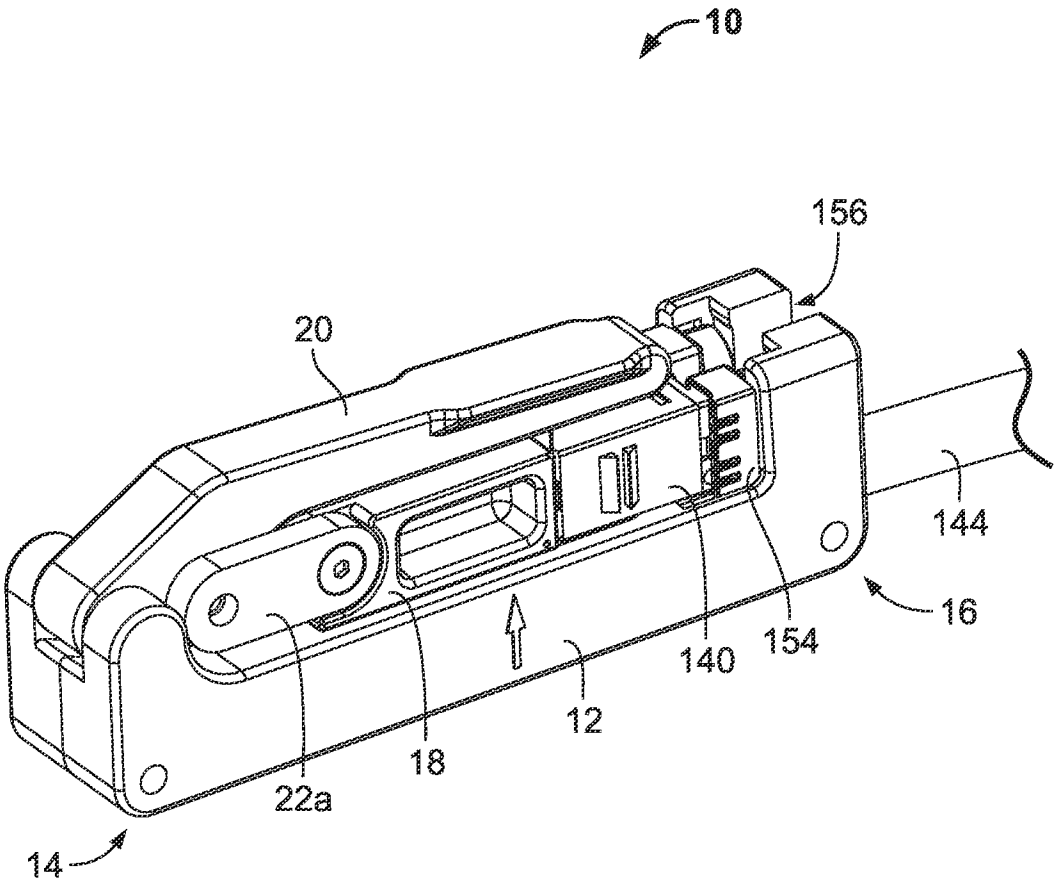
FIG. 35 illustrates a perspective view of the termination tool of FIG. 34 with the pivotable lever arm pressed such that the slider presses the horizontal style communication module into an engagement state with the termination device and into a final position.

Turning to FIGS. 34-35, the horizontal style communication module 140 can mount on the seat 56 of the base 12 for termination. FIG. 34 shows the termination device 154 and horizontal style communication module 140 in an initial position prior to engagement. FIG. 35 shows the termination device 154 and horizontal style communication module 140 in a final position in which the pivotable lever arm 20 has been pressed to move the slider 18 linearly on the base 12 for engagement with the horizontal style communication module 140. This allows the termination device 154 and horizontal style communication module 140 to be pressed into a final engagement state, in which the plurality of wires 164 are reliably electrically connected to the connection terminations 146, respectively, and trimmed. Front face 54 presses the second end 170 of horizontal style communication module 140, and protrusion 52 is received in port 172.

Turning again to FIG. 24, the body 148 of the horizontal style communication module 140 has a first end 168 and a second end 170, the connection terminations 146 can be mounted at the first end 168 of the body 148 such that the connection terminations 146 face opposite to a port 172 defined at the second end 170 of the body 148.

Figure 36:
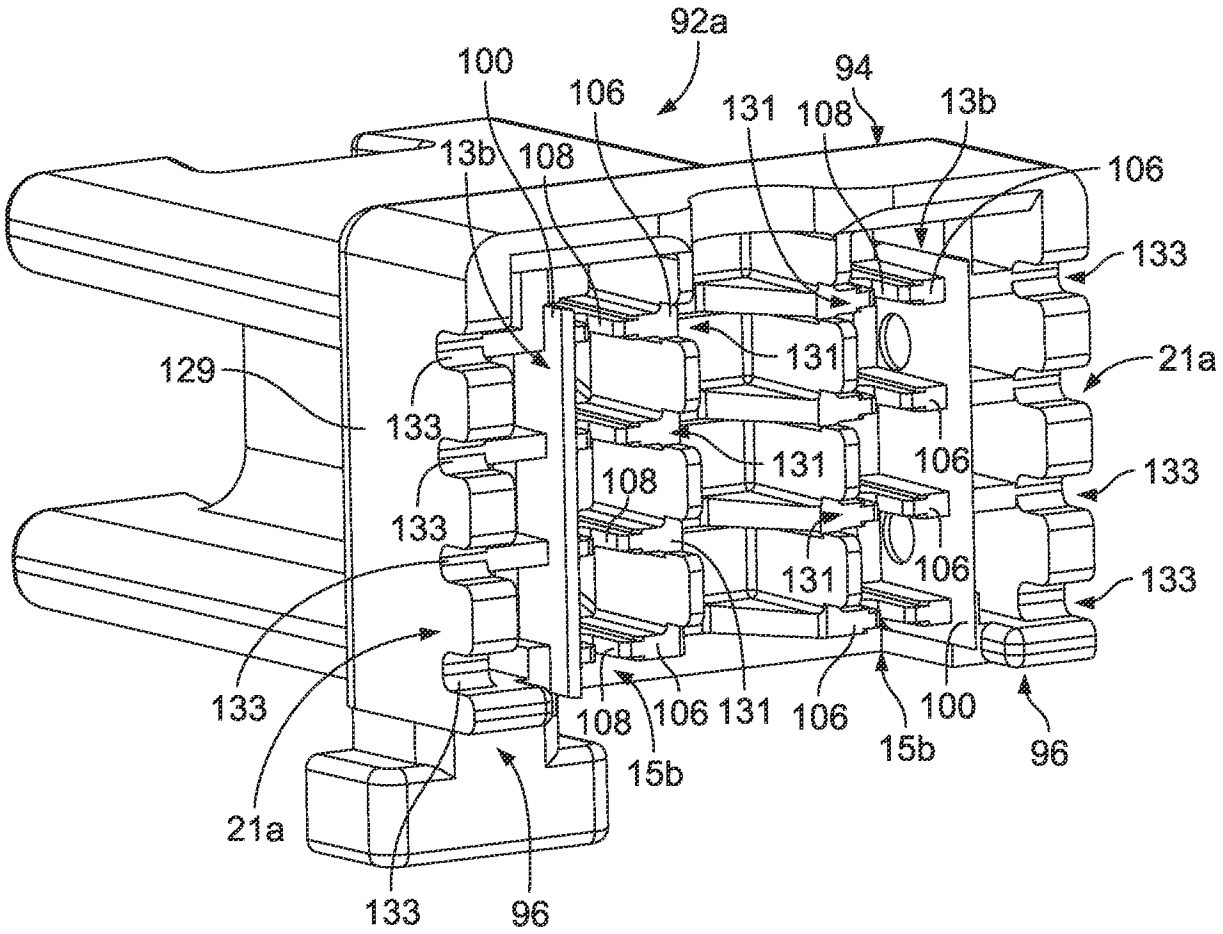
FIGS. 36-38 illustrate perspective views of another termination device including a lacing fixture in accordance with the principles of the present disclosure.
Figure 37:
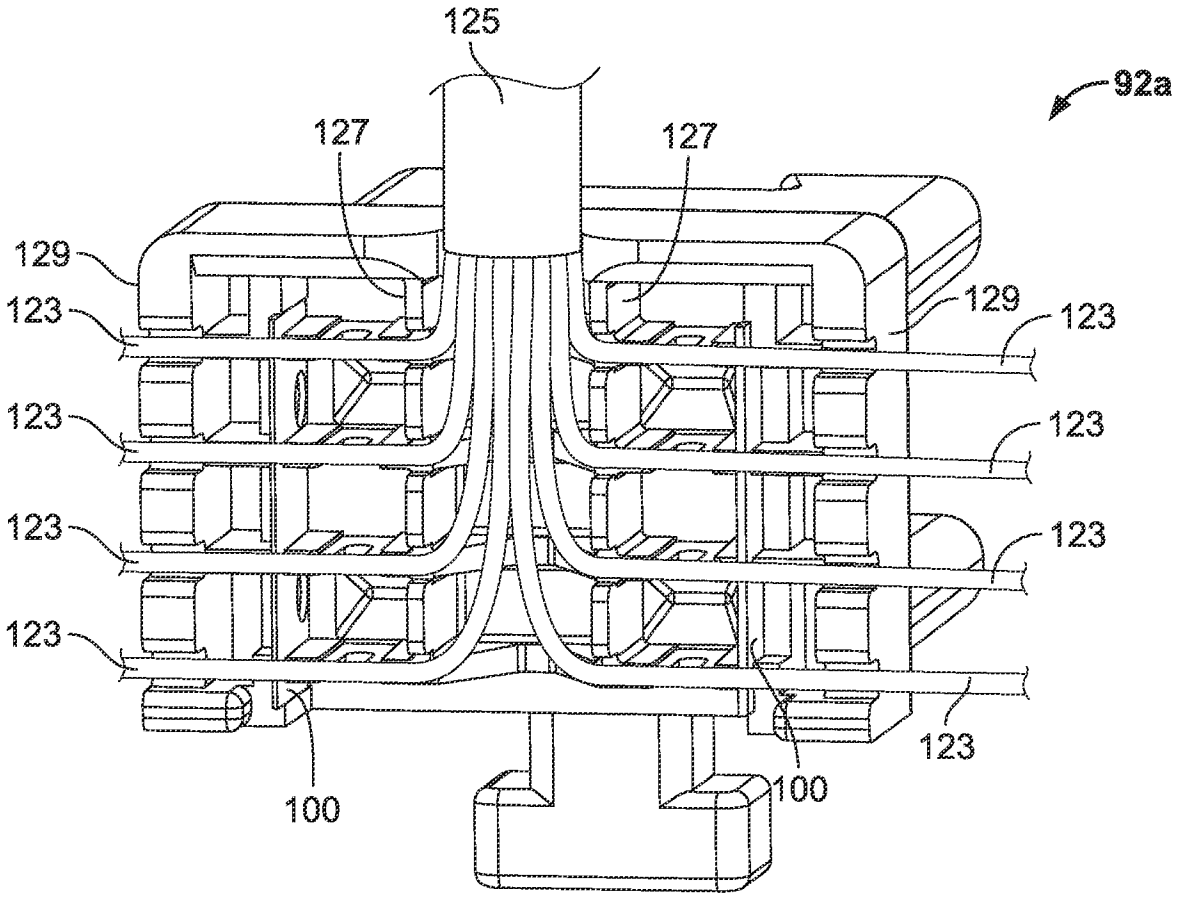
Figure 38:
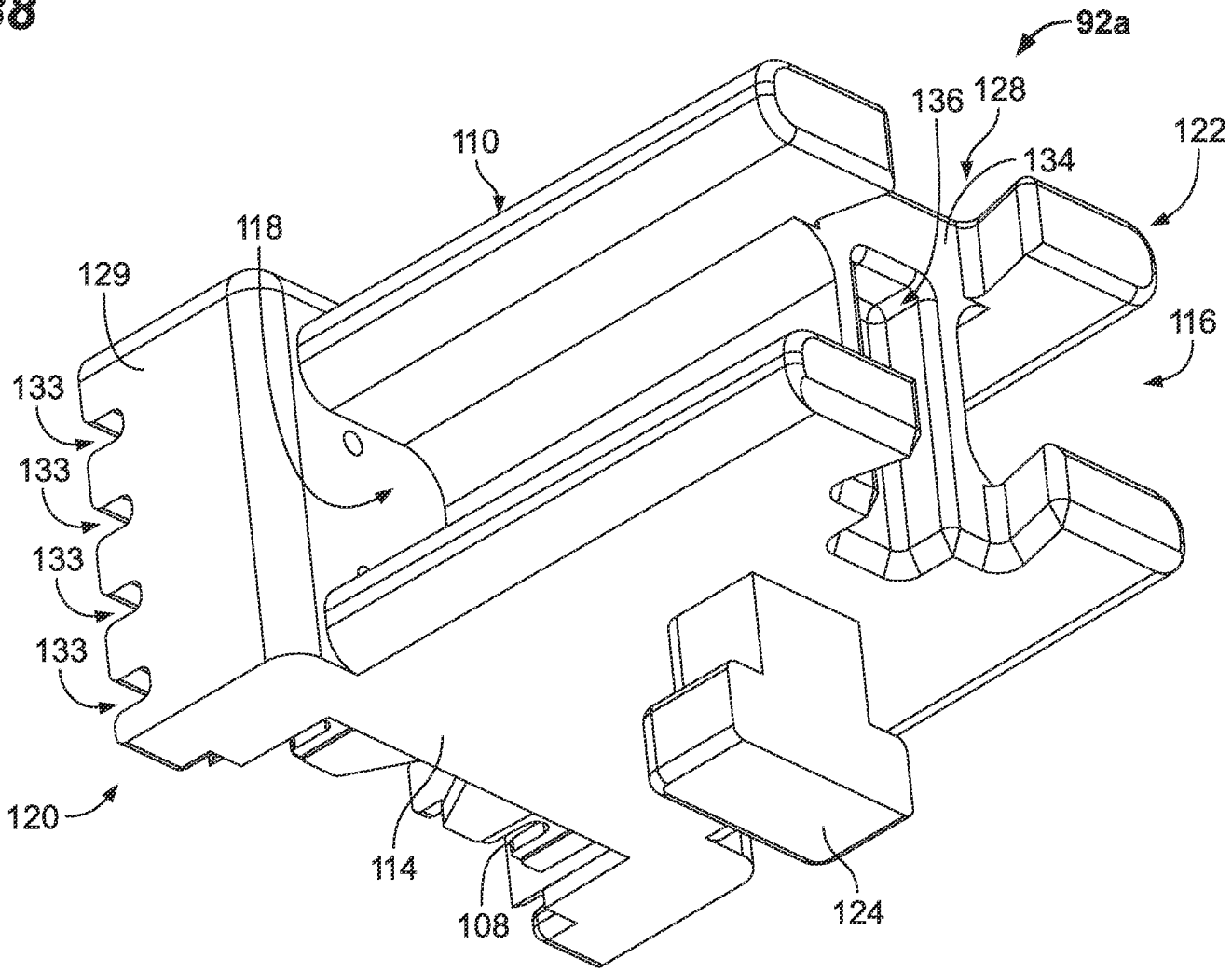

Referring to FIGS. 36-38, another example termination device 92*a* is illustrated for use with a jack, for example, the vertical style communication module 60.

The termination device 92*a* can include a wire cutting portion 13*b* and a wire pushing portion 15*b*. The termination device 92*a* also includes a wire holding portion 21*a* that forms a lacing fixture 94 (e.g., termination head) configured to hold a plurality of wires 123 of a cable 125 for termination to the vertical style communication module 60 and trimming by the cutting apparatus 100. In certain examples, the lacing fixture 94 can be made integral with the termination device 92.

The termination device 92*a* can be arranged and configured to terminate the wires 123 of the cable 125 to the plurality of insulation displacement connectors 68 of the vertical style communication module 60. The cutting apparatus 100 is configured to cut off parts or end portions of the wires 123 of the cable 125 after the wires 123 have been respectively terminated to the insulation displacement connectors 68.

In certain examples, the cutting apparatus 100 is integrated with the termination device 92*a*, although alternatives are possible. In certain examples, the cutting apparatus 100 is a separate part from the termination device 92*a*.

The termination device 92*a* includes two terminating segments 96 positioned parallel to each other. The terminating segments 96 are configured to separately hold the plurality of wires 123 extending in a longitudinal direction and parallel to each other. A cable holding segment 98 is positioned between the two terminating segments 96 to hold the cable 125.

The termination device 92*a* includes a first support wall 127 and a second support wall 129 parallel to the first support wall 127. The termination device 92*a* also includes the plurality of wire pushing walls 106 between the first and second support walls 127, 129. Each of the wire pushing walls 106 define the notch 108 for receiving the insulation displacement connectors 68 of the vertical style communication module 60.

A plurality of first holding slots 131 are formed in a first edge of the first support wall 127, each of the first holding slots 131 is aligned with a respective wire pushing wall 106. Similarly, a plurality of second holding slots 133 are formed in a first edge of the second support wall 129, each of the second holding slots 133 is aligned with a respective wire pushing wall 106. The plurality of wires 123 may be laced within the first and second holding slots 131, 133. With such configuration, the wires 123 held in the first holding slots 131 and the second holding slots 133 may be rested on the wire pushing walls 106.

Other than the wire holding portion 21*a*, the termination device 92*a* can include many of the same features described above with reference to the termination device 92 of FIGS. 11-17.

The termination device 92*a* can include the protrusion 124 that extends from the bottom surface 114 of the body 110. The termination device 92*a* can be attached to the slider 18 by the coupling arrangement 126.

Figure 39:
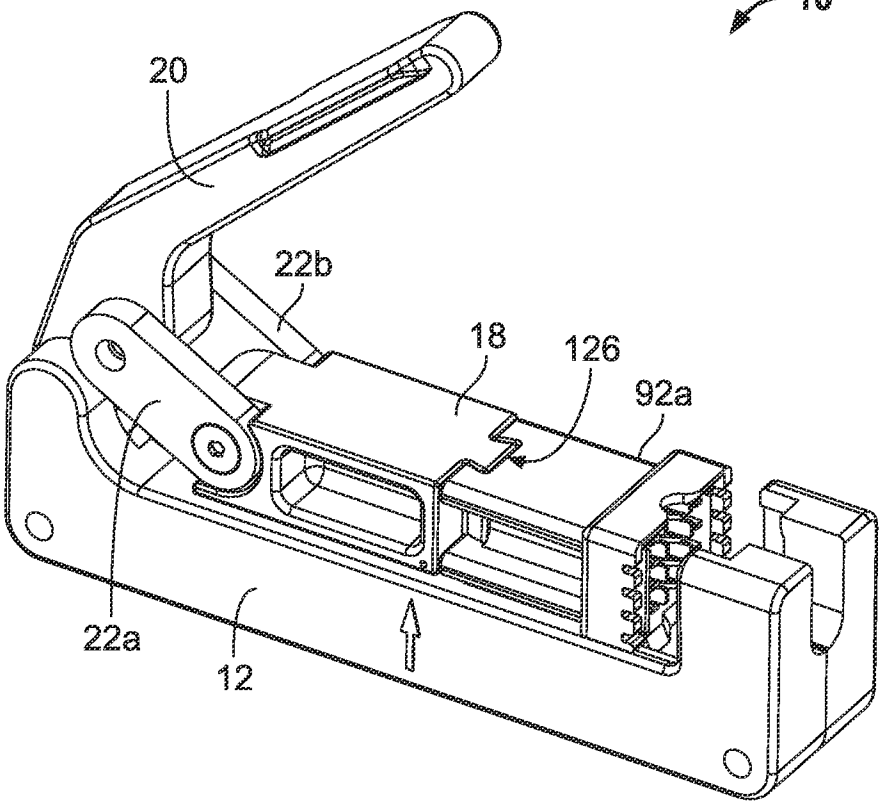
FIG. 39 illustrates the termination device of FIG. 36 mounted on the termination tool.

Referring to FIG. 39, the termination device 92*a* is shown mounted on the base 12. The termination device 92*a* is shown attached to the slider 18 by the coupling arrangement 126. The slider 18 is adapted to be connected to the termination device 92*a* as one-piece to operatively function as a lacing fixture. That is, the termination device 92*a* and the slider 18 can slide together such that the slider 18 becomes a lacing fixture for terminating the vertical style communication module 60.

Figure 40:
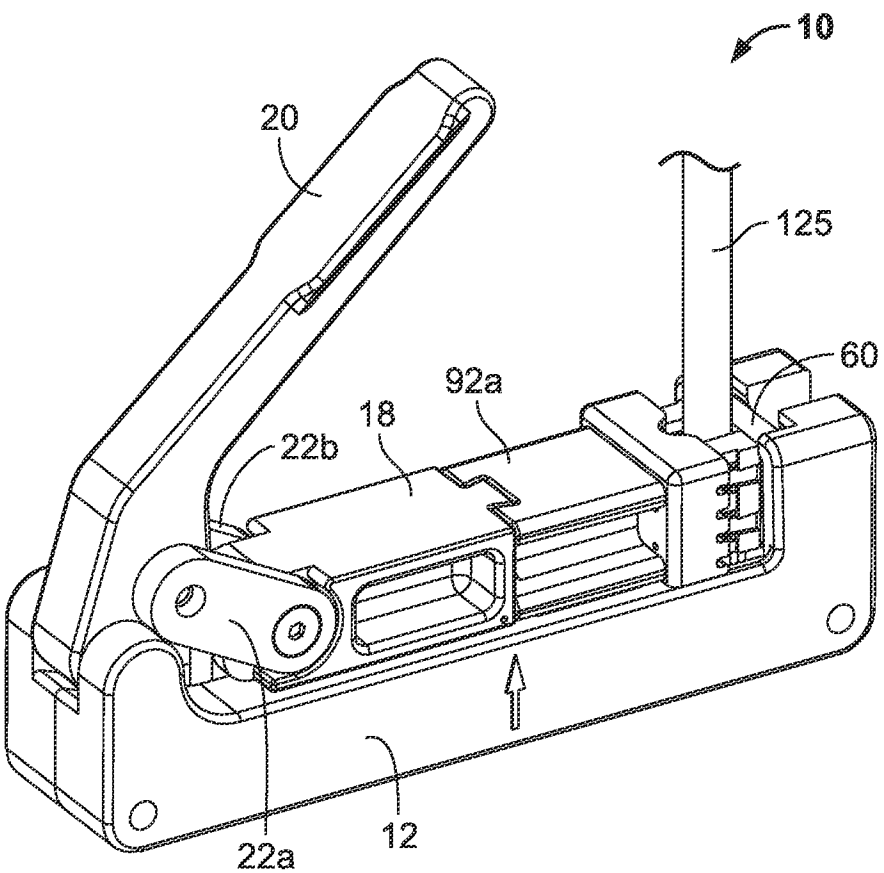
FIG. 40 illustrates a perspective view of the termination tool with the vertical style communication module and the termination device mounted thereon prior to termination.
Figure 41:
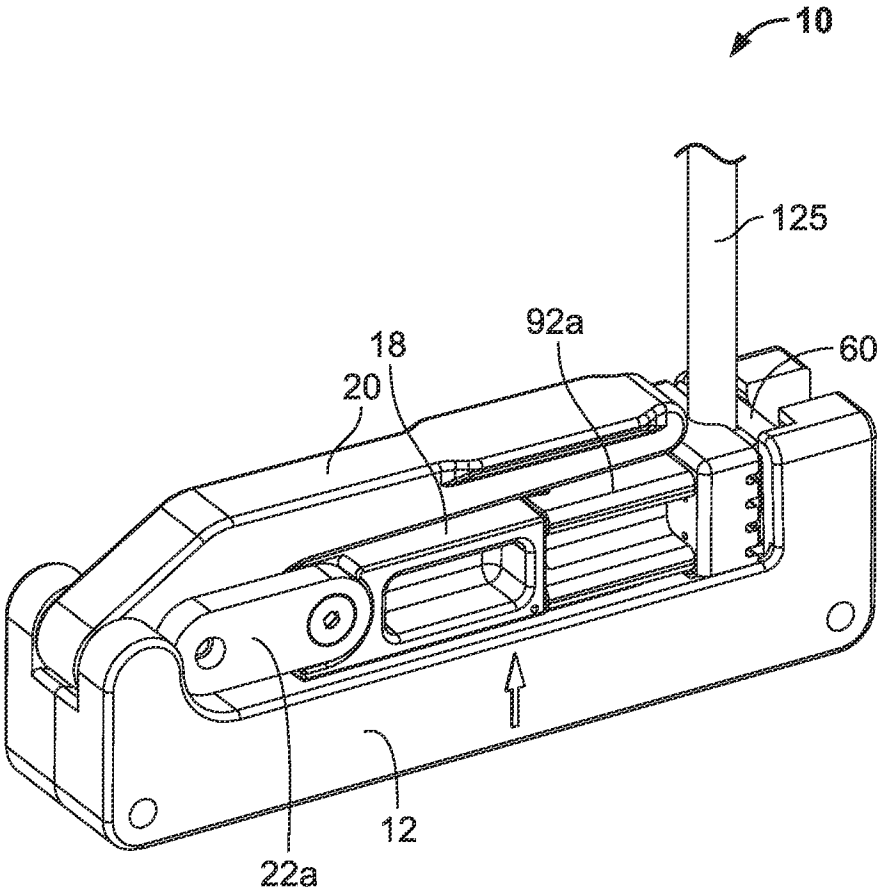
FIG. 41 illustrates a perspective view of the termination tool of FIG. 40 with the pivotable lever arm pressed to move the termination device and slider to a final position to terminate the vertical style communication module.

Referring to FIGS. 40-41, once the vertical style communication module 60 is prepared with the cable 125, the vertical style communication module 60 can be positioned within the pocket 58 of the base 12 such that the port 70 of the vertical style communication module 60 faces the bottom 90 of the pocket 58. The slider 18 and the termination device 92*a* are configured to be moved between an initial position (as shown in FIG. 39) and a final position (as shown in FIG. 41). In the initial position, the terminating segments 96 are preassembled in an initial engagement state with the plurality of insulation displacement connectors 68 of the vertical style communication module 60.

To terminate the wires of the cable 125, the pivotable lever arm 20 can be pressed so that both the termination device 92*a* and the slider 18 move toward the vertical style communication module 60. The slider 18 and the termination device 92*a* moving together as one-piece. The pivotable lever arm 20 can be pressed such that the slider 18 and the termination device 92*a* are in the final position for terminating and trimming a plurality of wires 123 of the cable 125 to the plurality of insulation displacement connectors 68 of the vertical style communication module 60. Once termination is complete, the pivotable lever arm 20 can be opened and the vertical style communication module 60 can be removed from the tool 10.

Another aspect of the present disclosure relates to a method of using a termination tool for different jack types. The method may include steps of: 1) arranging the termination tool in a first jack configuration that includes: a) mounting a first termination device at a distal end of a base of the termination tool, where the first termination device can have a first plurality of wires of a first cable; b) inserting a first jack horizontally onto the base of a housing of the termination tool between a slider and the first termination device; c) pressing a pivotable lever arm to a closed position to move the slider toward the first jack to respectively terminate the first plurality of wires of the first cable to a plurality of connection terminations of the first jack; and d) opening the pivotable lever arm and removing the first jack and the first termination device; and 2) arranging the termination tool in a second jack configuration that includes: a) attaching a second termination device to the slider positioned on the base of the housing, b) inserting a second jack vertically into the base of the housing adjacent the second termination device at the distal end of the base; c) pressing the pivotable lever arm to the closed position to move the second termination device into engagement with the second jack to respectively terminate a second plurality of wires of a second cable to connection terminations of the second jack; and d) opening the pivotable lever arm and removing the second jack.

In certain examples, the second termination device can include a wire holding portion that holds the second plurality of wires of the second cable. In certain examples, the second jack can hold the second plurality of wires of the second cable. In certain examples, the method can include a step of cutting end portions off of the first and second plurality of wires during termination.

The present disclosure can also include a method of terminating different jack types with a termination tool. The method can include steps of: 1) mounting a first termination device at a distal end of a base of the termination tool; 2) inserting a first jack horizontally onto the base of a housing between a slider and the first termination device; 3) terminating the first jack by pressing a pivotable lever arm to a closed position to move the slider in engagement with the first jack to respectively terminate a first plurality of wires of a first cable to a plurality of connection terminations of the first jack; 4) opening the pivotable lever arm and removing the first jack and the first termination device; 5) attaching a rear end of a second termination device to a front end of the slider positioned on the base of the housing; 6) inserting a second jack vertically into the base of the housing adjacent a front end of the second termination device at the distal end of the base; 7) pressing the pivotable lever arm to the closed position to slide the slider and the second termination device where the front end of the second termination device engages the second jack to respectively terminate a second plurality of wires of a second cable to connection terminations of the second jack; and 8) opening the pivotable lever arm and removing the second jack.

In certain examples, the second termination device can include a wire holding portion that holds the second plurality of wires of the second cable. In certain examples, the second jack can hold the second plurality of wires of the second cable.

The present disclosure further relates to a method of terminating a cable having a plurality of wires with a communication module having a plurality of connection terminals. The method can include steps of: 1) providing a tool including a base, a slider mounted within a slot defined in the base, and a pivotable lever arm coupled to the base and to the slider; 2) attaching a termination device to the slider, the termination device can have a lacing fixture that holds the plurality of wires of the cable; 3) inserting the communication module vertically into the base adjacent the lacing fixture; and 4) pressing the pivotable lever arm to move the slider into engagement with the communication module to terminate the plurality of wires of the cable to the plurality of connection terminals of the communication module.

From the forgoing detailed description, it will be evident that modifications and variations can be made without departing from the spirit and scope of the disclosure.

What is claimed is:

1. A tool for terminating different jack types to a cable with a plurality of wires, comprising:

a housing with a base;

a slider having sliding rail feet that are received within a guide shot defined in the base;

a pivotable lever arm couples to the housing via a pivotal shaft and to the slider, the pivotable lever arm being configured to linearly move the slider between an initial position and a final position;

the base including a seat capable of fitting a first jack type with connectors for terminating the plurality of wires of the cable, a first port arranged on an opposite end of the first jack type, a second jack type with connectors for terminating the plurality of wires of the cable and a second port oriented 90 degrees relative to the connectors on the second jack type; and the slider being mounted within a slot defined in the base, wherein the slider directly engages the first jack type with the first port facing the slider and the connectors facing away from the slider when terminating the first jack type, and the slider receives a termination device that directly engages the second jack type with the connectors facing the termination device and the second port facing the seat when terminating the second jack type.

2. The tool of claim 1, wherein the first jack type has a first body with a first end and a second end, first insulation displacement connectors being mounted at the first end of the first body such that the insulation displacement connectors face opposite to the first port defined at the second end of the first body.

3. The tool of claim 2, wherein the second jack type has a second body with a first end and a second end, second insulation displacement connectors being mounted at the first end of the second body, the second body defining the second port at the second end thereof.

4. The tool of claim 3, wherein the base defines a pocket for receiving the second jack type in a vertical orientation.

5. The tool of claim 1, wherein the termination device includes a lacing fixture for holding the plurality of wires of the cable, wherein the plurality of wires extend parallel to each other.

6. The tool of claim 5, wherein the slider includes a dovetail tongue portion and the termination device includes a dovetail groove portion for receiving the dovetail tongue portion of the slider, wherein when the slider and termination device are engaged on the base, the slider becomes the lacing fixture to terminate the second jack type.

7. The tool of claim 1, wherein the termination device includes at least one cutting apparatus to cut off parts of the plurality of wires after the plurality of wires are respectively terminated to a plurality of connection terminations of the second jack type.

8. The tool of claim 7, wherein the at least one cutting apparatus is integrated with the termination device.

9. The tool of claim 1, wherein the slider extends longitudinally along the base a greater distance than the first jack type positioned horizontally thereon to engage the first jack type with the termination device.

10. The tool of claim 1, wherein the slider has a length from end to end that is at least twice a length of the first jack type.

11. The tool of claim 1, wherein the slider has a length from end to end that is at least 1.5 times longer than a length of the first jack type.

12. The tool of claim 1, wherein the slider has a length from end to end that is between 0.25 to 1.5 times longer than a length of the first jack type.

13. The tool of claim 1, wherein the slider has a length from end to end that is 10%-50% greater than a length of the first jack type.

14. The tool of claim 1, wherein the tool is configured to receive another termination device for the first jack type.

15. The tool of claim 1, wherein the tool defines a pocket in the base for receiving the second jack type.

16. The tool of claim 1, wherein the second jack type holds the plurality of wires of the cable to terminate to connection terminations of the second jack type.

* * * * *